US008602537B2

(12) United States Patent
Katoh

(10) Patent No.: US 8,602,537 B2
(45) Date of Patent: Dec. 10, 2013

(54) IMAGE FORMING APPARATUS

(75) Inventor: Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 307 days.

(21) Appl. No.: 13/033,687

(22) Filed: Feb. 24, 2011

(65) Prior Publication Data

US 2011/0216111 A1 Sep. 8, 2011

(30) Foreign Application Priority Data

Mar. 2, 2010 (JP) ..... 2010-045258

(51) Int. Cl.
*B41J 29/38* (2006.01)
*B41J 2/175* (2006.01)

(52) U.S. Cl.
USPC ..... 347/85; 347/84

(58) Field of Classification Search
USPC ..... 347/6, 20, 28–30, 84–88; 400/719
IPC ..... B41J 2/175,29/38
See application file for complete search history.

(56) References Cited

U.S. PATENT DOCUMENTS 7,325,908 B2 2/2008 Katoh et al.
7,841,706 B2 11/2010 Ishinaga et al.
2006/0274133 A1* 12/2006 Inoue et al. ..... 347/93
2007/0291086 A1* 12/2007 Murakami et al. ..... 347/85
2008/0297568 A1* 12/2008 Seshimo ..... 347/85
2009/0051724 A1 2/2009 Katoh
2009/0284572 A1 11/2009 Katoh
2009/0290002 A1 11/2009 Katoh
2010/0214378 A1 8/2010 Katoh et al.

FOREIGN PATENT DOCUMENTS

JP 2002-178537 6/2002
JP 2005-342960 12/2005
JP 2005-342961 12/2005
JP 2006-150745 6/2006
JP 2007-185905 7/2007

* cited by examiner

*Primary Examiner* — Manish S Shah
*Assistant Examiner* — Roger W Pisha, II
(74) *Attorney, Agent, or Firm* — Cooper & Dunham LLP

(57) ABSTRACT

Disclosed is an image forming apparatus that includes a recording head, a liquid tank, a first flow path, a second flow path, a pressure regulation unit, a third flow path, and a liquid supply unit. The pressure regulation unit varies fluid resistance in accordance with a remaining amount of liquid inside the liquid tank, decreases the fluid resistance if the remaining amount of the liquid is equal to or greater than a predetermined amount, increases the fluid resistance if the remaining amount of the liquid is less than the predetermined amount, and supplies the liquid with the liquid supply unit to eject liquid droplets from the recording head, thereby generating a circulation flow that flows through the third flow path and the flow path of the pressure regulation unit.

6 Claims, 20 Drawing Sheets

FIG.18A
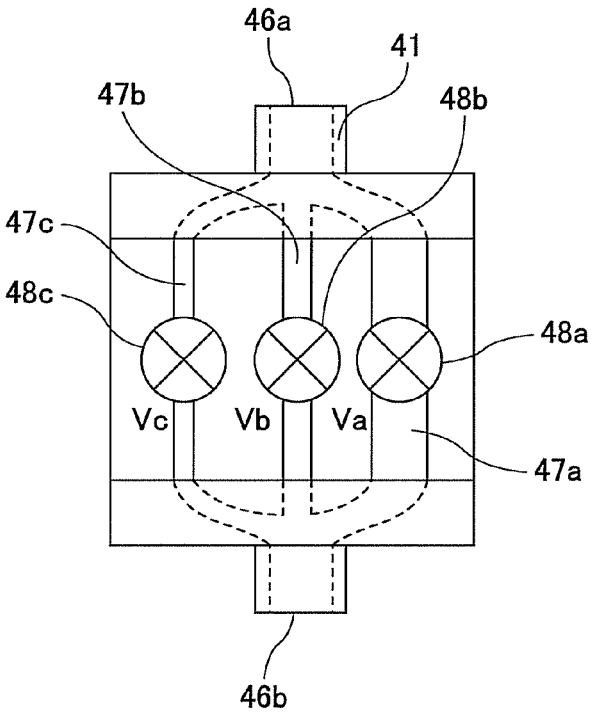
FIG.18B
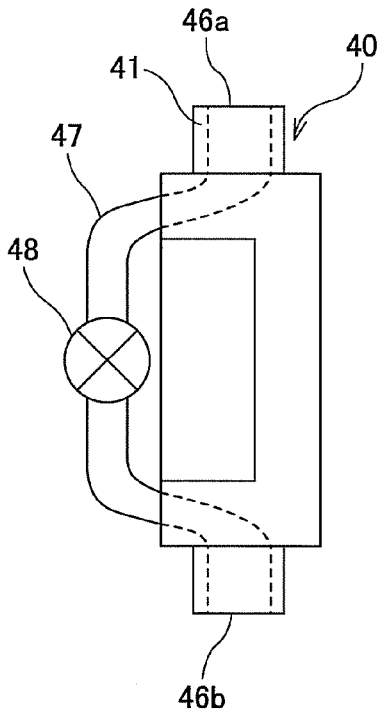
FIG.19
| | | Va | Vb | Vc |
|---|---|---|---|---|
| ↑ REMAINING AMOUNT OF INK | 1 | OPEN | OPEN | OPEN |
| | 2 | OPEN | OPEN | CLOSED |
| | 3 | OPEN | CLOSED | OPEN |
| | 4 | OPEN | CLOSED | CLOSED |
| | 5 | CLOSED | OPEN | OPEN |
| | 6 | CLOSED | OPEN | CLOSED |
| ↓ SMALL | 7 | CLOSED | CLOSED | OPEN |

IMAGE FORMING APPARATUS

BACKGROUND OF THE INVENTION

1. Field of the Invention

The present invention generally relates to image forming apparatuses and, in particular, to an image forming apparatus having a recording head that ejects liquid droplets.

2. Description of the Related Art

As an image forming apparatus such as a printer, a facsimile machine, a copier, a plotter, and a multi-task machine having plural such functions, a known ink jet recording apparatus of a liquid ejection recording type uses a recording head that ejects, for example, ink liquid droplets. The image forming apparatus of this type ejects ink droplets onto a sheet during conveyance from the recording head to perform image formation (used synonymously with recording, printing, and imaging). Examples of an image forming apparatus include a serial-type image forming apparatus in which a recording head ejects liquid droplets to form an image while moving in a main scanning direction and a line-type image forming apparatus using a line-type head in which a recording head ejects liquid droplets to form an image without moving.

Note that in the present invention, an "image forming apparatus" refers to an apparatus that ejects ink droplets onto a medium such as paper, a thread, a fiber, a fabric, leather, metal, a plastic, glass, wood, and a ceramic so as to perform image formation. Further, "image formation" refers to forming not only relevant images such as characters and graphics but also irrelevant images such as patterns on a medium (the image forming apparatus also includes one referred to as a liquid droplet ejection apparatus or a liquid ejection apparatus that merely ejects liquid droplets onto a medium). Further, "ink" is not limited to one as generally called ink but is used as a generic name of various liquids available for image formation such as recording liquid, fixing treatment liquid, DNA samples, and patterning materials. Further, the material of a "sheet" is not limited to paper. That is, the sheet refers to those including an OHP sheet, a fabric, etc., onto which ink droplets are ejected and is used as a generic name of those including a medium to be recorded on, a recording medium, a recording sheet, a recording paper, etc. Further, an "image" is not limited to a two-dimensional image but also refers to an image added to a three-dimensional object and an image obtained by shaping an object into three dimensions.

A known liquid ejection head (a liquid droplet ejection head) used as a recording head includes a piezoelectric-type liquid ejection head and a thermal-type head. The piezoelectric-type liquid ejection head deforms a vibration plate with a piezoelectric actuator or the like and changes the volumes of liquid chambers. Thus, the piezoelectric-type liquid ejection head increases pressure inside the liquid chambers to eject liquid droplets. Further, the thermal-type head is provided with a heat generation body that generates heat when liquid chambers are energized. Thus, in ejecting liquid droplets, the thermal-type head increases pressure inside the liquid chambers with air bubbles produced when the heat generation body generates heat.

Such image forming apparatuses of the liquid ejection type are expected to in the future particularly increase image forming throughput, i.e., accelerate an image forming speed. Therefore, the image forming apparatus employs a method to for supplying ink from a high-capacity ink cartridge (main tank) installed in a main body a sub-tank (also including those referred to as a buffer tank) provided at the upper part of a recording head via a tube. According to the method (tube supply method) for supplying ink using the tube, a carriage part can be reduced in weight and downsized. In addition, the apparatus including a structure system and a driving system can be significantly downsized.

On the other hand, in order to stably perform liquid ejection with the recording head, it is necessary to apply appropriate negative pressure to nozzles. If the negative pressure is too low, liquid runs from the head. On the other hand, if the negative pressure is too high, the liquid ejection becomes unstable or is disabled.

A configuration for generating negative pressure in the ink supply system described above includes a method for connecting the ink cartridge to the recording head in communication with air by a tube and merely arranging the ink cartridge to be below the recording head. In this method, the negative pressure is obtained according to a water head difference between the ink cartridge and the recording head.

However, in this method, the water head difference fluctuates due to the lowering of the liquid surface of ink inside the ink cartridge when the ink is consumed in the ink cartridge. Therefore, the negative pressure inside the head may be gradually increased. With the increase in the negative pressure inside the head, problems such as unstable ink ejection and a difficulty in restoring the nozzles from their clogged state as described above are caused.

Accordingly, in order to maintain a head at constant pressure, Patent Document 1 (JP-A-2005-342961) discloses a configuration for communicating a head with a circulation path that circulates ink inside a sub-tank, detecting pressure inside the head that fluctuates according to the ejection status of the head with a pressure sensor, and controls the circulation pump provided in the circulation path based on a detection result.

However, the configuration disclosed in Patent Document 1 (JP-A-2005-342961) requires complicated control using the pressure sensor to compensate for the fluctuation of a water head difference.

SUMMARY OF THE INVENTION

The present invention has been made in view of the above problems and may have an object of maintaining the negative pressure inside a head at an appropriate range with a simple configuration.

According to a first aspect of the present invention, there is provided an image forming apparatus including a recording head having nozzles from which liquid droplets are ejected; a liquid tank that stores a liquid to be supplied to the recording head; a first flow path through which the liquid is supplied to the recording head; a second flow path in communication with the liquid tank; a pressure regulation unit having a flow path that connects the first flow path with the second flow path; a third flow path that bypasses the pressure regulation unit to connect the second flow path or the liquid tank with the first flow path; and a liquid supply unit provided in the third flow path. The pressure regulation unit varies a fluid resistance in accordance with a remaining amount of the liquid inside the liquid tank, decreases the fluid resistance if the remaining amount of the liquid is equal to or greater than a predetermined amount, increases the fluid resistance if the remaining amount of the liquid is less than the predetermined amount, and supplies the liquid with the liquid supply unit to eject the liquid droplets from the recording head, thereby generating a circulation flow that flows through the third flow path and the flow path of the pressure regulation unit.

According to a second aspect of the present invention, there is provided an image forming apparatus including a recording head having nozzles from which liquid droplets are ejected; a liquid tank that stores a liquid to be supplied to the recording head; a first flow path through which the liquid is supplied to the recording head; a second flow path in communication with the liquid tank; a fluid resistance part having a flow path that connects the first flow path with the second flow path; a third flow path that bypasses the pressure regulation unit to connect the second flow path or the liquid tank with the first flow path; a liquid supply unit provided in the third flow path; and a unit that supplies the liquid with the liquid supply unit to eject liquid droplets from the recording head, thereby generating a circulation flow that flows through the third flow path and the flow path of the fluid resistance part. The unit controls a flow rate to be supplied by the liquid supply unit to be decreased if the remaining amount of the liquid is equal to or greater than a predetermined amount and the flow rate to be increased if the remaining amount of the liquid is less than the predetermined amount in accordance with the remaining amount of the liquid inside the liquid tank.

According to a third aspect of the present invention, there is provided an image forming apparatus including a recording head having nozzles from which liquid droplets are ejected; a liquid tank that stores a liquid to be supplied to the recording head; a first flow path through which the liquid is supplied to the recording head; a second flow path in communication with the liquid tank; a pressure regulation unit having a flow path that connects the first flow path with the second flow path; a third flow path that bypasses the pressure regulation unit to connect the second flow path or the liquid tank with the first flow path; and a liquid supply unit provided in the third flow path. The pressure regulation unit varies a fluid resistance in accordance with a remaining amount of the liquid inside the liquid tank, decreases the fluid resistance if the remaining amount of the liquid is equal to or greater than a predetermined amount, increases the fluid resistance if the remaining amount of the liquid is less than the predetermined amount, and supplies the liquid with the liquid supply unit to perform a maintenance and restoration operation for the recording head, thereby generating a circulation flow that flows through the third flow path and the flow path of the pressure regulation unit.

According to fourth aspect of the present invention, there is provided an image forming apparatus including a recording head having nozzles from which liquid droplets are ejected; a liquid tank that stores a liquid to be supplied to the recording head; a first flow path through which the liquid is supplied to the recording head; a second flow path in communication with the liquid tank; a fluid resistance part having a flow path that connects the first flow path with the second flow path; a third flow path that bypasses the pressure regulation unit to connect the second flow path or the liquid tank with the first flow path; a liquid supply unit provided in the third flow path; and a unit that supplies the liquid with the liquid supply unit to perform a maintenance and restoration operation for the recording head, thereby generating a circulation flow that flows through the third flow path and the flow path of the fluid resistance part. The unit controls a flow rate to be supplied by the liquid supply unit to be decreased if the remaining amount of the liquid is equal to or greater than a predetermined amount and the flow rate to be increased if the remaining amount of the liquid is less than the predetermined amount in accordance with the remaining amount of the liquid inside the liquid tank.

Other objects, features and advantages of the present invention will become more apparent from the following detailed description when read in conjunction with the accompanying drawings.

BRIEF DESCRIPTION OF THE DRAWINGS

FIGS. 18A and 18B are explanatory views for explaining a fluid resistance variable unit in the third embodiment;

FIG. 19 is an explanatory table for explaining the combination of opening/closing control operations using opening/closing valves of the fluid resistance variable unit;

DETAILED DESCRIPTION OF THE PREFERRED EMBODIMENTS

Figure 1:
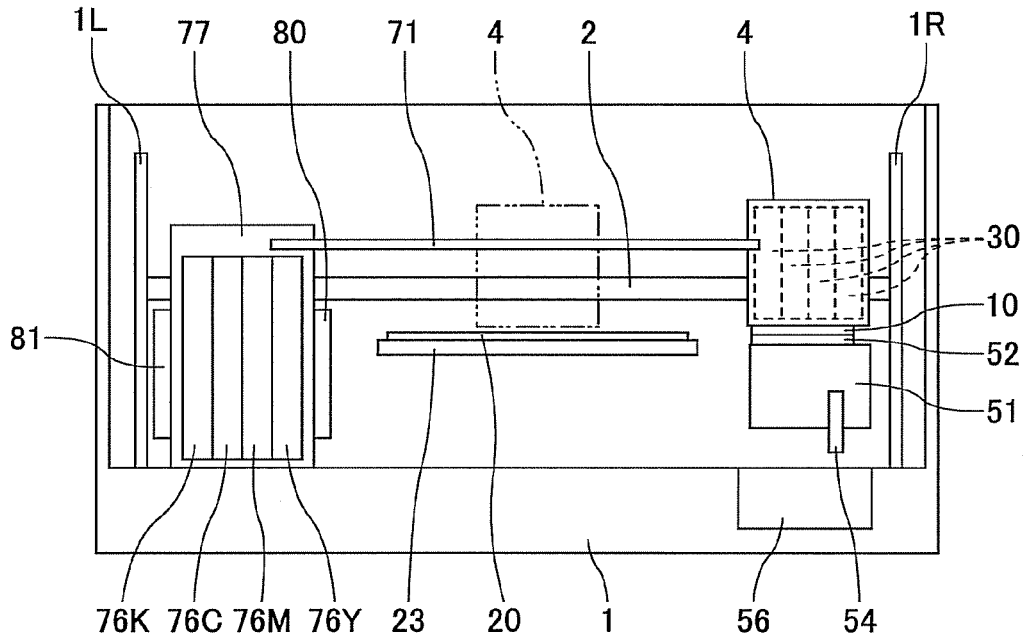
FIG. 1 is a schematic front explanatory view of an ink jet recording apparatus acting as an image forming apparatus according to an embodiment of the present invention.
Figure 2:
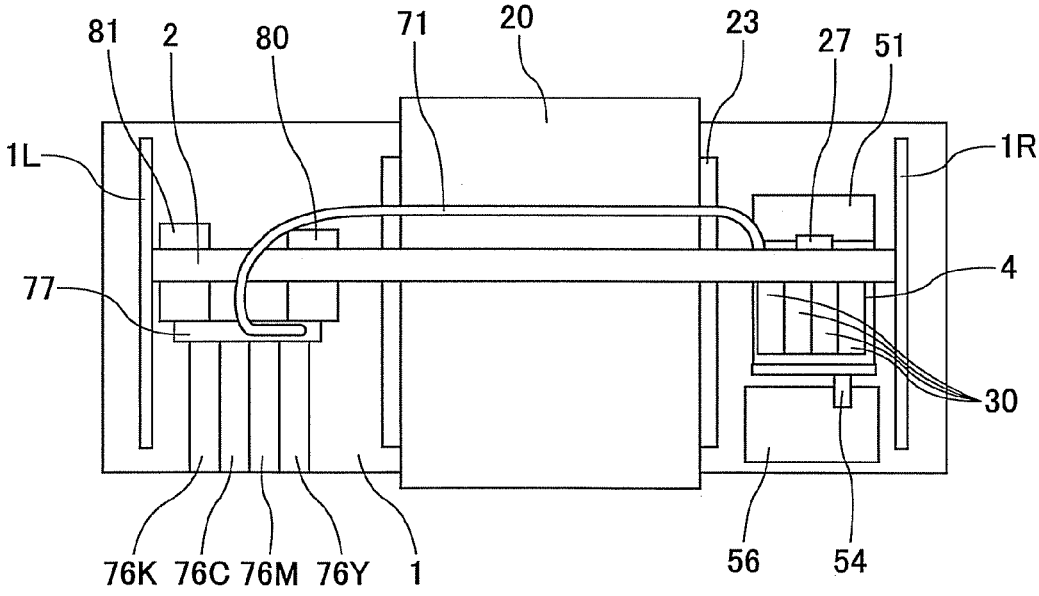
FIG. 2 is a schematic plan explanatory view of the ink jet recording apparatus.
Figure 3:
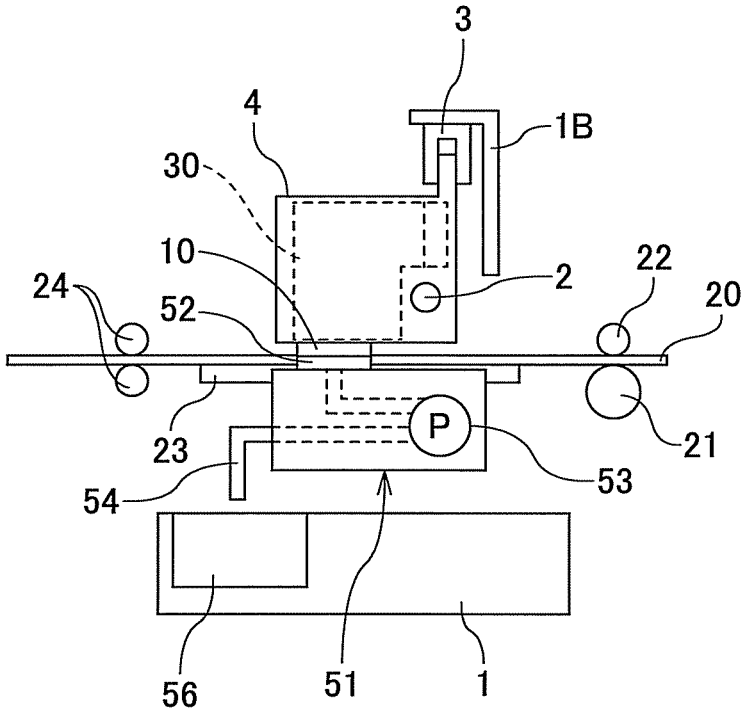
FIG. 3 is a schematic side explanatory view of the ink jet recording apparatus.

Hereinafter, referring to the accompanying drawings, embodiments of the present invention are described. Referring to FIGS. 1 through 3, a description is made of an ink jet recording apparatus acting as an image forming apparatus according to an embodiment of the present invention. Note that FIG. 1 is a schematic front explanatory view of the ink jet recording apparatus, FIG. 2 is a schematic plan explanatory view of the ink jet recording apparatus, and FIG. 3 is a schematic side explanatory view of the ink jet recording apparatus.

In the ink jet recording apparatus, a carriage 4 is slidably held in a main scanning direction (in the longitudinal direction of a guide rod) by the guide rod 2 acting as a guide member bridged across right and left side plates 1L and 1R projectingly provided on a main body frame 1 and by a guide rail 3 attached to a rear frame 1B bridged across the main body frame 1. Thus, the carriage 4 is moved to scan in the longitudinal direction (main scanning direction) of the guide rod 2 by a main scanning motor 551 (see FIG. 11) and a timing belt.

In the carriage 4, one or more recording heads 10 that eject ink droplets of, for example, black (K), cyan (C), magenta (M), and yellow (Y) are mounted. Each of the recording heads 10 is mounted on the carriage 4 with its plural ink ejection ports (nozzles) arranged in a direction crossing the main scanning direction and its ink droplet ejection direction facing downward.

Figure 4:
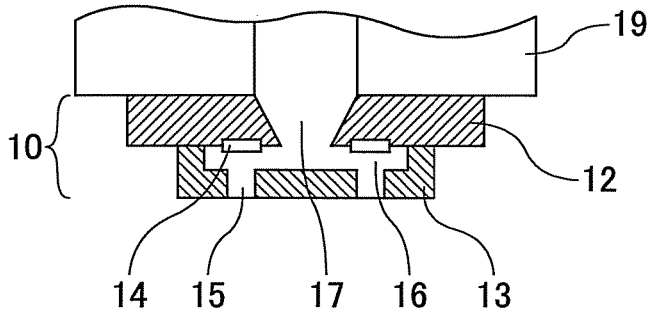
FIG. 4 is an enlarged explanatory view of a substantial part for explaining the recording head of the ink jet recording apparatus.

Here, as shown in FIG. 4, the recording head 10 is composed of a heat generator substrate 12 and a liquid chamber forming member 13, and ejects as liquid droplets ink successively supplied to a common flow path 17 and a liquid chamber (separate flow path) 16 via an ink supply path formed in a base member 19. The recording head 10 is a thermal-type recording head that obtains ejection pressure through the film boiling of ink generated when a heat generator 14 is driven, and employs a side-shooter method in which the flow direction of the ink to an ejection energy operation part (heat generator part) inside the liquid chamber 16 and the central axes of the openings of nozzles 15 form a right angle.

Note that although various types of recording heads such as one that deforms a vibration plate with piezoelectric elements or an electrostatic force to obtain ejection pressure are known, any type of the recording heads is applicable to the image forming apparatus according to the embodiments of the present invention.

Further, some of the thermal-type recording heads employ an edge-shooter method in which ejection directions are different from each other. However, the edge-shooter method causes so-called cavitation in which the heat generator 14 is gradually broken due to an impact when air bubbles collapse. Conversely, the side-shooter method grows air bubbles, and the air bubbles are in communication with air when they reach the nozzles 15. Therefore, the shrinkage of the air bubbles due to a decrease in temperature does not occur. For this reason, the side-shooter method is advantageous in that the service life of the recording head is increased. Further, the side-shooter method can more efficiently convert energy from the heat generator 14 into heat for forming ink droplets and kinetic energy for jetting the ink droplets, and also has a structural advantage in that the restoration of meniscuses by the supply of ink becomes fast. Accordingly, the ink jet recording apparatus according to the embodiments of the present invention has the recording head employing the side-shooter method.

On the other hand, below the carriage 4, a sheet 20 on which an image is formed by the recording head 10 is conveyed in a direction (sub-scanning direction) perpendicular to the main scanning direction. As shown in FIG. 3, the sheet 20 is conveyed to the image forming region (print region) of the recording head 10 while being held by a conveyance roller 21 and a press roller 22, fed onto a print guide member 23, and fed in a sheet ejection direction by a pair of sheet ejection rollers 24.

At this time, scanning by the carriage 4 in the main scanning direction and ink ejection by the recording head 10 are synchronized with each other at an appropriate timing based on image data, and an image corresponding to one band is formed on the sheet 20. After the formation of the image corresponding to the one band, the sheet 20 is fed in the sub-scanning direction by a predetermined amount to perform the recording operation as described above. These operations are repeatedly performed to form an image corresponding to one page.

On the other hand, a sub-tank (buffer tank or head tank) 30 in which an ink chamber for temporarily storing the ink to be ejected is integrally formed at the upper part of the recording head 10. Here, the expression "integrally formed" also includes connecting the recording head 10 to the sub-tank 30 via a tube, a pipe, or the like and refers to a state in which the recording head 10 and the sub-tank 30 are both mounted on the carriage 4.

The respective colors of ink are supplied from an ink cartridge (main tank) 76 acting as a liquid tank according to the embodiments of the present invention storing the respective colors of ink and detachably attached to a cartridge holder 77 provided on the side of the one end part of an apparatus main body in the main scanning direction to the sub-tank 30 via a liquid supply tube 71 acting as a tube member forming a part of the ink supply paths and forming a first flow path.

Further, on the side of the other end part of the apparatus main body in the main scanning direction, a maintenance and restoration mechanism 51 that maintains and restores the recording head 10 is arranged. The maintenance and restoration mechanism 51 has a cap 52 that caps the nozzle surface of the recording head 10, a suction pump 53 that suctions the ink inside the cap 52, a discharge path 54 through which the drainage of the ink suctioned by the suction pump 53 is discharged, and the like. The drainage discharged through the discharge path 54 is discharged into a drainage tank 56 arranged on the side of the main body frame 1. The maintenance and restoration mechanism 51 has a moving mechanism (cap moving mechanism 513 in FIG. 11 described below) that moves (in this example moves up and down) the cap 52 with respect to the nozzle surface of the recording head 10. Further, as shown in FIG. 9 described below, in the maintenance and restoration mechanism 51, a wiper member 57 that wipes off the nozzle surface of the recording head 10 is held on a wiping unit 58 and provided so as to be capable of moving with respect to the nozzle surface.

Figure 5:
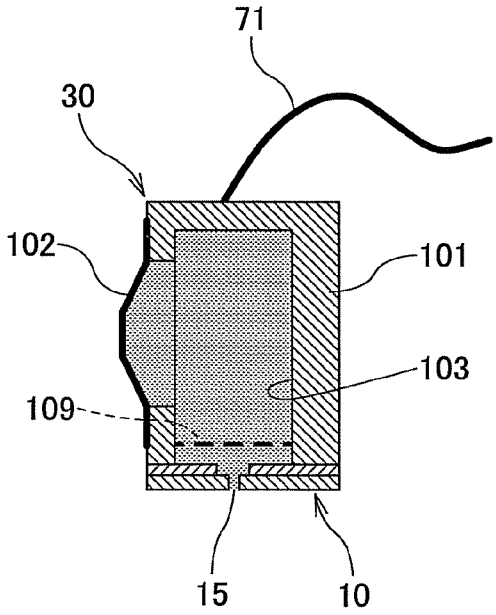
FIG. 5 is a schematic cross-sectional explanatory view of the sub-tank of the ink jet recording apparatus.
Figure 6:
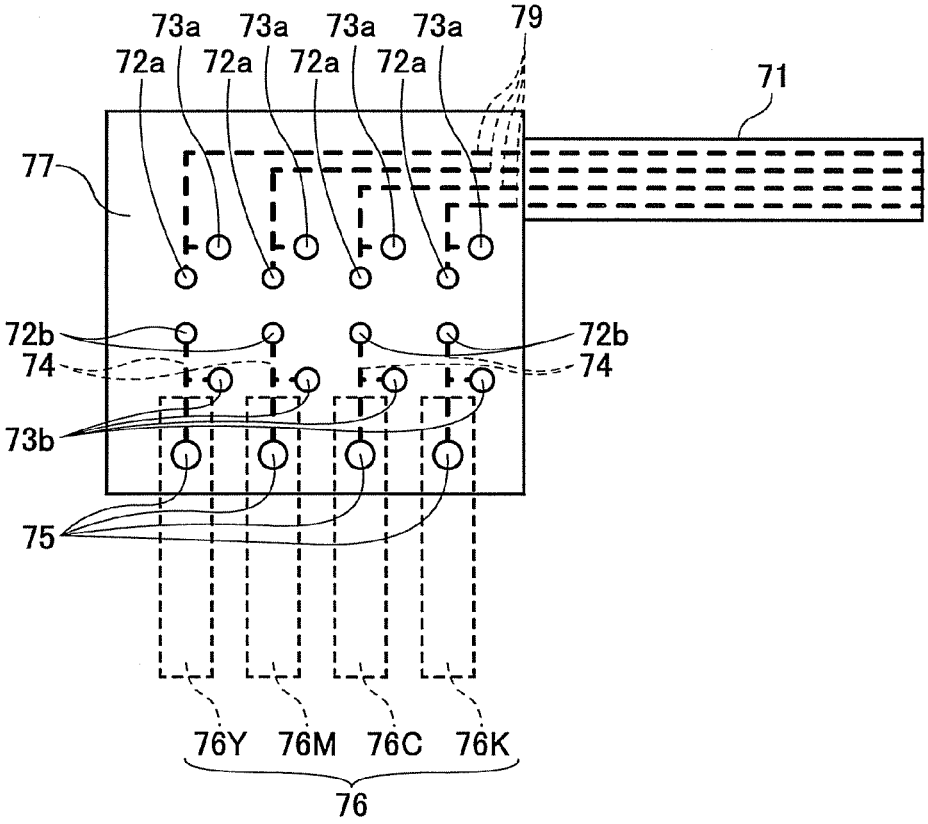
FIG. 6 is an explanatory view of the part of the cartridge holder of the ink jet recording apparatus.
Figure 7:
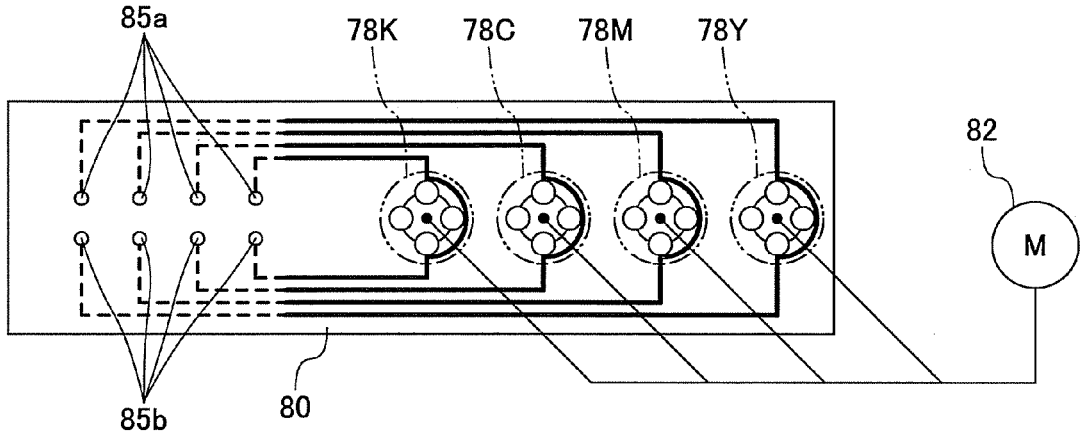
FIG. 7 is an explanatory view of the pump unit of the ink jet recording apparatus.
Figure 8:
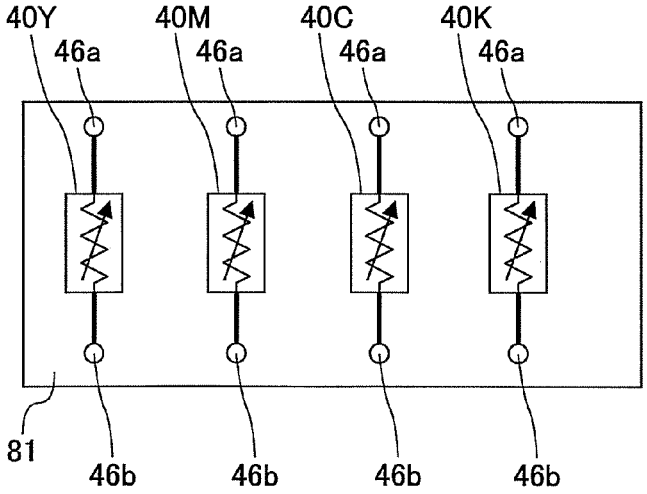
FIG. 8 is an explanatory view of the pressure control unit of the ink jet recording apparatus.
Figure 9:
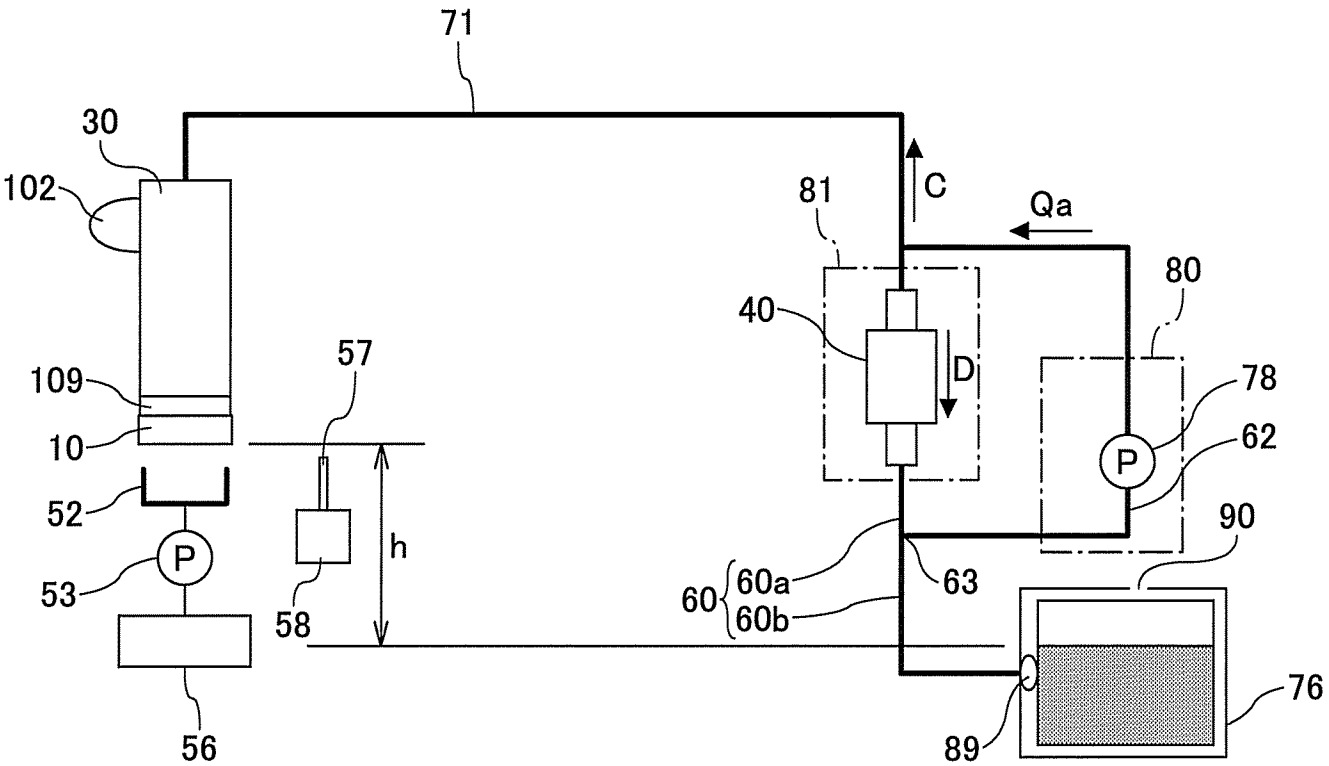
FIG. 9 is an explanatory view of an ink supply system according to a first embodiment of the present invention.

Next, referring also to FIG. 5 through FIGS. 10A through 10D, a description is made of an ink supply system according to a first embodiment of the present invention applied to the ink jet recording apparatus. Note that FIG. 5 is a schematic cross-sectional explanatory view of the sub-tank of the ink supply system, FIG. 6 is an explanatory view of the part of the cartridge holder of the ink supply system, FIG. 7 is an explanatory view of the pump unit of the ink supply system, FIG. 8 is an explanatory view of the pressure control unit of the ink supply system, FIG. 9 is an explanatory view of the ink supply system, and FIGS. 10A through 10D are explanatory views showing an example of a fluid resistance variable unit.

First, the sub-tank 30 is configured to have a rubber member 102 having flexibility and formed into a convex shape toward an outside at one opening of a tank case 101 forming an ink chamber 103, have a filter 109 near a connection part between the ink chamber 103 and the recording head 10 inside the ink chamber 103, and supply the ink from which foreign matter is removed by filtration to the recording head 10.

One end part of the ink supply tube 71 is connected to the sub-tank 30. Further, as shown in FIGS. 1 and 2, the other end part of the ink supply tube 71 is connected to the cartridge holder 77 installed in the main body.

The ink cartridge 76, a pump unit 80 acting as a liquid supply unit, and a pressure control unit 81 are connected to the cartridge holder 77.

As shown in FIG. 6, inner flow paths (not shown), 74 and 79 are formed corresponding to the respective colors of ink inside the cartridge holder 77. Further, the cartridge holder 77 has pump connection ports 73*a* and 73*b* in communication with the pump unit 80 and has pressure control ports 72*a* and 72*b* in communication with the pressure control unit 81.

As shown in FIG. 7, the pump unit 80 has ports 85*a* and 85*b* in communication with the pump connection ports 73*a* and 73*b* of the cartridge holder 77, respectively, and has pumps (assist pumps) 78 acting as liquid supply units in communication with the ports 85*a* and 85*b*. As the pumps 78, various pumps such as tubing pumps, diaphragm pumps, and gear pumps may be employed. In FIG. 7, the pump unit 80 includes the four pumps 78K, 78C, 78M, and 78Y corresponding to the four colors of ink. The four pumps 78K, 78C, 78M, and 78 are configured to operate simultaneously with a motor 82.

As shown in FIG. 8, the pressure control unit 81 has ports 46*a* and 46*b* in communication with the pressure control ports 72*a* and 72*b* of the cartridge holder 77, respectively, and has a fluid resistance variable unit 40 acting as a pressure regulation unit in communication with the ports 46*a* and 46*b*.

Next, referring to a schematic configuration view shown in FIG. 9, a description is made of the entire configuration of the ink supply system. Note that FIG. 9 shows only main constituents connected to the single liquid ejection head (recording head) 10 to facilitate the understanding of the operations and effects of the ink supply system.

The ink supply system has the ink cartridge 76 acting as the liquid tank that stores ink to be supplied to the recording head 10; the liquid supply tube 71 (hereinafter also referred to as a "first flow path") acting as the first flow path through which the ink is supplied to the recording head 10; a second flow path 60 having a branch part 63 along its way and in communication with the ink cartridge 76, the second flow path 60 including a section 60*a* between the pressure control unit 81 and the branch part 63 and a section 60*b* between the branch part 63 and the ink cartridge 76; the pressure control unit 81 including the fluid resistance variable unit 40 acting as the pressure regulation unit that connects the first flow path 71 with the second flow path 60; a third flow path 62 that bypasses the fluid resistance variable unit 40 to connect the branch part 63 with the first flow path 71; and the pump unit 80 acting as the liquid supply unit provided in the third flow path 62.

Here, the fluid resistance variable unit 40 varies fluid resistance with hydrostatic pressure applied to its inner flow path.

Figure 10A:
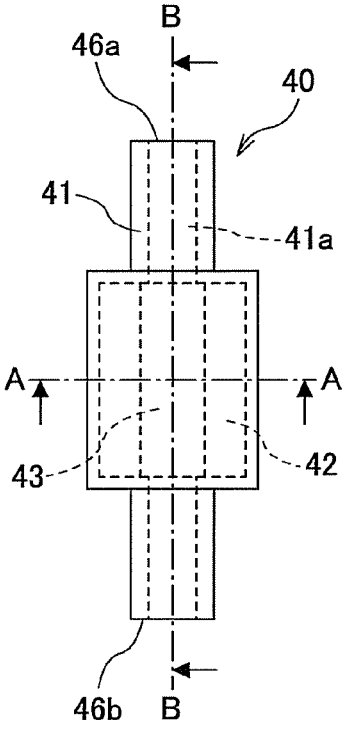
FIGS. 10A through 10D are explanatory views for explaining a fluid resistance variable unit in the first embodiment.
Figure 10C:
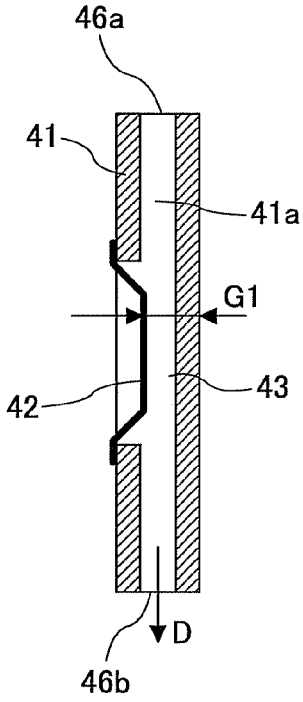
Figure 10D:
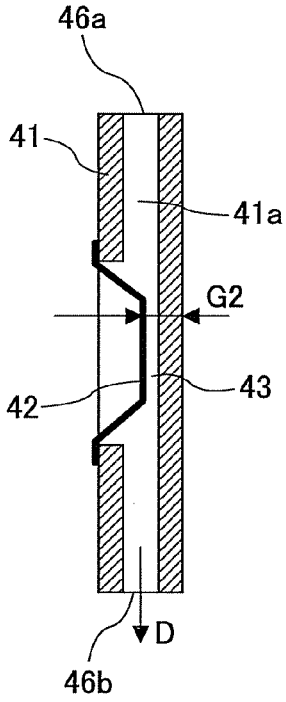
Figure 10B:
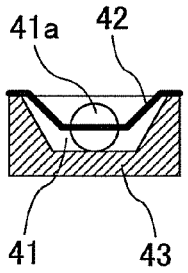

Next, referring to FIGS. 10A through 10D, a description is made of an example of the fluid resistance variable unit 40. Note that FIG. 10A is a front explanatory view of the fluid resistance variable unit 40, FIG. 10B is a cross-sectional explanatory view taken along line A-A shown in FIG. 10A, and FIGS. 10C and 10D are cross-sectional explanatory views showing different states taken along line B-B shown in FIG. 10A.

In the fluid resistance variable unit 40, a pressure regulation chamber 43 that varies fluid resistance is provided in a part of a flow path 41*a* formed inside a flow path forming member 41. In the pressure regulation chamber 43, a rectangular opening part facing the flow path 41*a* is provided in the flow path forming member 41 and covered with a cover member 42 formed of an elastic member like rubber acting as a flexible member. When the cover member 42 is deformed by hydrostatic pressure, the squeezing amount (length) of the flow path is varied. As a result, the fluid resistance is varied.

Referring back to FIG. 9, the ink cartridge 76 is provided with an air communication part 90, and the liquid surface of the ink inside the ink cartridge 76 is positioned to be lower than the nozzle surface of the recording head 10. Thus, in a state where the ink fills in all the ink supply paths, negative pressure is generated in the recording head 10 by a water head difference h between the recording head 10 and the liquid surface of the ink inside the ink cartridge 76.

Here, referring to FIG. 9 and FIGS. 10A through 10D, a description is made of a pressure regulation principle in the ink supply system of this embodiment.

As described above, in the ink supply system of this embodiment, a vertical interval is provided between the head 10 and the ink cartridge 76 opened to air so as to maintain the head 10 at appropriate pressure. Accordingly, when the ink inside the ink cartridge 76 is reduced, the liquid surface of the ink is lowered. Therefore, the vertical interval (water head difference) between the head 10 and the liquid surface of the ink inside the ink cartridge 76 is increased, and the pressure inside the head 10 is increased in a negative pressure direction.

There is no problem with the increase in the negative pressure inside the head 10 as long as it is small. However, if the ink cartridge 76 is, for example, a high-capacity-type ink cartridge, the position of the liquid surface is greatly changed as the ink is consumed. Therefore, the negative pressure thus varied is not negligible. As the negative pressure is greatly varied, the size of ink droplets ejected from the head 10 is changed. As a result, problems such as unstable image formation and ejection abnormalities are caused. Further, since it is difficult for the meniscuses of the nozzles to be easily formed again in a nozzle restoration operation, restoring the nozzles becomes difficult.

Therefore, in the ink supply system of this embodiment, the increase in the negative pressure inside the ink cartridge 76 caused when the water head of the ink cartridge 76 is changed is suppressed by the change of fluid resistance of the fluid resistance variable unit 40 and the supply of the liquid by the (assist) pumps 78.

First, when the remaining amount of the ink inside the ink cartridge 76 is large, the fluid variable resistance unit 40 is deformed according to pressure inside the pressure regulation chamber 43 as shown in FIG. 10C because one wall surface of the pressure regulation chamber 43 is formed of the cover member 42 acting as the flexible member. When the remaining amount of the ink inside the ink cartridge 76 is decreased in this state, the pressure inside the pressure regulation chamber 43 is reduced. Therefore, as shown in FIG. 10D, the cover member 42 is pressed inside to be inwardly deformed.

In other words, the fluid resistance variable unit 40 is configured to reduce (G1→G2) the length of a gap forming the flow path of the pressure regulation chamber 43 when the remaining amount of the ink inside the ink cartridge 76 is decreased.

As described above, since the fluid resistance variable unit 40 is configured to automatically vary the fluid resistance according to a pressure difference between the fluid resistance variable unit 40 and the ink cartridge 76, the configuration of the pressure regulation unit is simplified. Further, since the flexible member is used in the part of the flow path, the configuration of the pressure regulation unit is further simplified. Moreover, since the elastic member is used as the flexible member, the squeezing amount (amount of fluid resistance) of the pressure regulation chamber 43 can be elastically varied. As a result, the characteristics of the pressure regulation chamber 43 are stabilized.

On the other hand, referring back to FIG. 9, the ink supply system of this embodiment has the third flow path (bypass flow path) 62 that bypasses the fluid resistance variable unit 40, and the assist pumps 78 are provided in the bypass flow path 62.

When the ink is supplied by the assist pumps 78 in a direction as indicated by arrow Qa, some of the ink to be ejected from the head 10 flows in a direction as indicated by arrow C while the rest of the ink flows in a direction as indicated by arrow D. As a result, the ink circulates through the fluid resistance variable unit 40 and the assist pumps 78.

Accordingly, inside the fluid resistance variable unit 40, the ink flows in a direction as indicated by arrow D in FIGS. 10C and 10D. When the ink flows in the direction as indicated by the arrow D, pressure corresponding to the size of the fluid resistance of the pressure regulation chamber 43 is generated. Therefore, the smaller the gap of the pressure regulation chamber 43 is, i.e., the smaller the remaining amount of the ink inside the ink cartridge 76 is and the greater the negative pressure inside the head 10 is, the greater is positive pressure generated in the pressure regulation chamber 43. Thus, the increase in the negative pressure inside the head 10 is cancelled.

As described above, even if the negative pressure inside the head is increased due to the water head difference when the remaining amount of the ink inside the ink cartridge 76 is changed, the pressure regulation chamber 43 automatically generates the positive pressure to stably maintain the pressure inside the head 10. As a result, the ejection performance of the head 10 can be satisfactorily maintained. Further, even in performing the nozzle restoration operation when the nozzles of the head 10 are clogged, the negative pressure inside the head 10 can fall in a prescribed range regardless of the remaining amount of the ink inside the ink cartridge. As a result, the restoration performance of the head 10 can be satisfactorily obtained.

Figure 11:
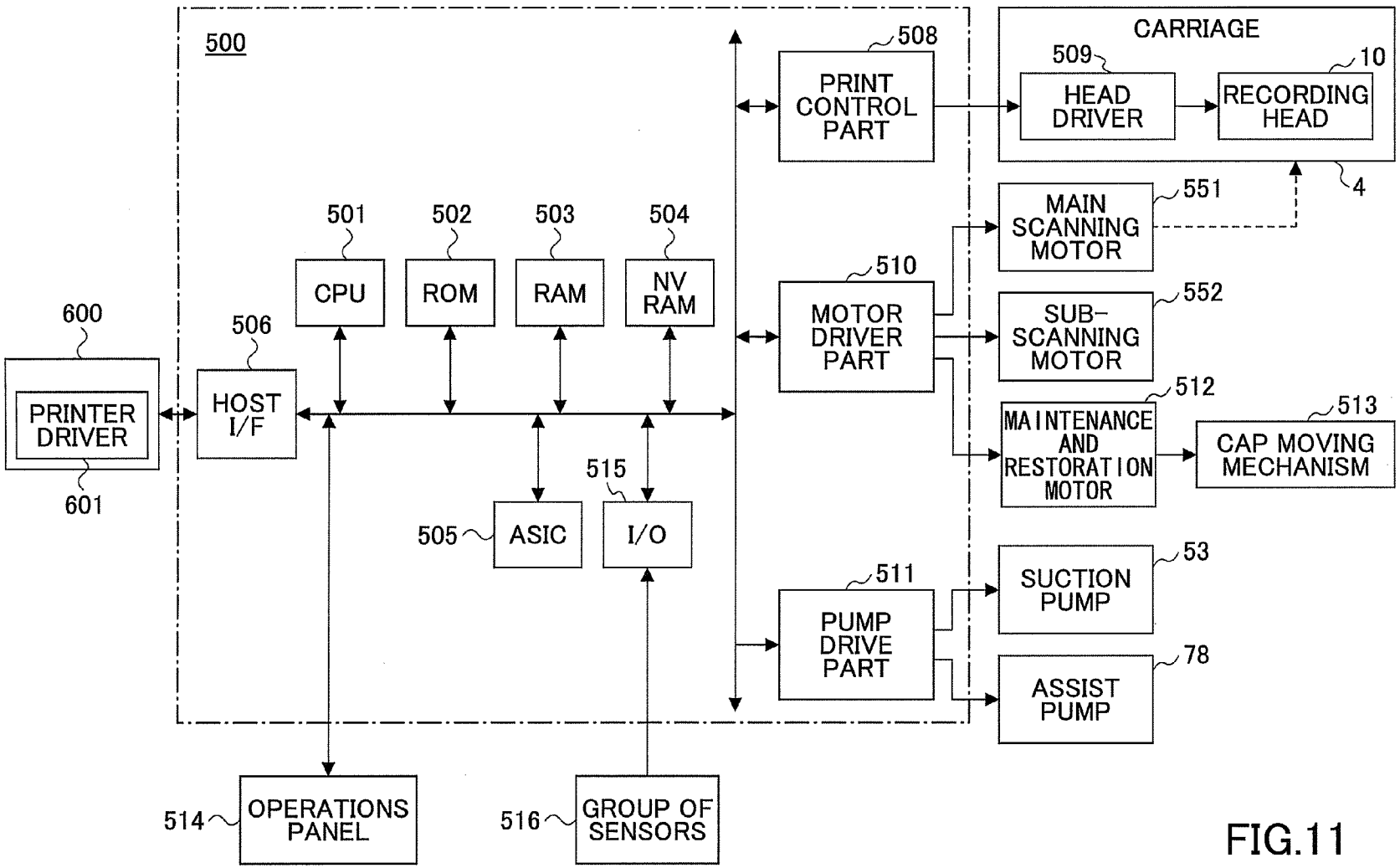
FIG. 11 is a block explanatory diagram for explaining the outline of the control unit of the image forming apparatus.

Next, referring to FIG. 11, a description is made of the outline of the control unit of the image forming apparatus. Note that FIG. 11 is an entire block explanatory diagram of the control unit.

The control unit 500 has a CPU 501, a ROM 502, a RAM 503, a rewritable non-volatile memory 504, and an ASIC 505. The CPU 501 controls the entirety of the image forming apparatus while acting also as a unit that performs various controls according to the embodiments of the present invention. The RAM 502 stores a program executed by the CPU 501 and other fixed data. The RAM 503 temporarily stores image data or the like. The rewritable non-volatile memory 504 maintains data even when the apparatus is powered off. The ASIC 505 performs image processing such as various signal processing and rearrangement with respect to image data and input/output signal processing for controlling the entirety of the apparatus.

Further, the control unit 500 has a print control part 508, a head driver (driver IC) 509, a motor drive part 510, a pump drive part 511, and the like. The print control part 508 drives and controls the recording head 10 in accordance with print data. The head driver 509 drives the recording head 10 on the side of the carriage 4. The motor drive part 510 drives the main scanning motor 551 that moves the carriage 4 to perform scanning, a sub-scanning motor 552 that rotates and drives the conveyance roller 21 for conveying the sheet 20, and a maintenance and restoration motor 512 that operates the cap moving mechanism 513 for moving the cap 52, the wiper member 57, or the like of the maintenance and restoration mechanism 51. The pump drive part 511 drives the suction pump 53 of the maintenance and restoration mechanism 51 and the assist pumps 78.

Further, the control unit 500 is connected to an operations panel 514 on which information items necessary for the apparatus are input and displayed.

The control unit 500 has an I/F 506 that sends and receives data and signals to and from a host. The I/F 506 receives the data and signals from the host 600 such as an information processing apparatus like a personal computer, an image reading apparatus like an image scanner, and an image pick-up apparatus like a digital camera via a cable or a network.

In the control unit 500, the CPU 501 reads and analyzes print data inside a receive buffer included in the I/F 506, the ASIC 505 performs necessary image processing, data rearrangement processing, or the like, and the print control part 508 transfers image data to the head driver 509. Note that dot pattern data for image output are generated by a printer driver 601 of the host 600.

The print control part 508 transfers the print data described above as serial data and outputs to the head driver 509 a transfer clock, a latch signal, a control signal, or the like necessary for the transfer of the print data and determining the transfer, or the like. The head driver 509 drives the heat generator 14 based on the serially-input print data corresponding to one line of the recording head 10.

An I/O part 515 acquires information items from a group of sensors 516, extracts information items necessary for controlling the printer from the extracted information items, and uses the extracted information items for controlling the print control part 508 and the motor drive part 510. The group of sensors 516 includes an optical sensor that detects the position of a sheet, a thermistor that monitors temperature inside the apparatus, a sensor that monitors the voltage of a charged belt, an interlock switch that detects the opening/closing status of a cover, and the like. The I/O part 515 can process information items from the various sensors. Further, a detection signal from a temperature and humidity detection sensor that detects environmental conditions (temperature and humidity) and a detection signal from a fill-up status detection sensor that detects the fill-up status of the drainage tank 56 are also input to the I/O part 515.

Figure 12:
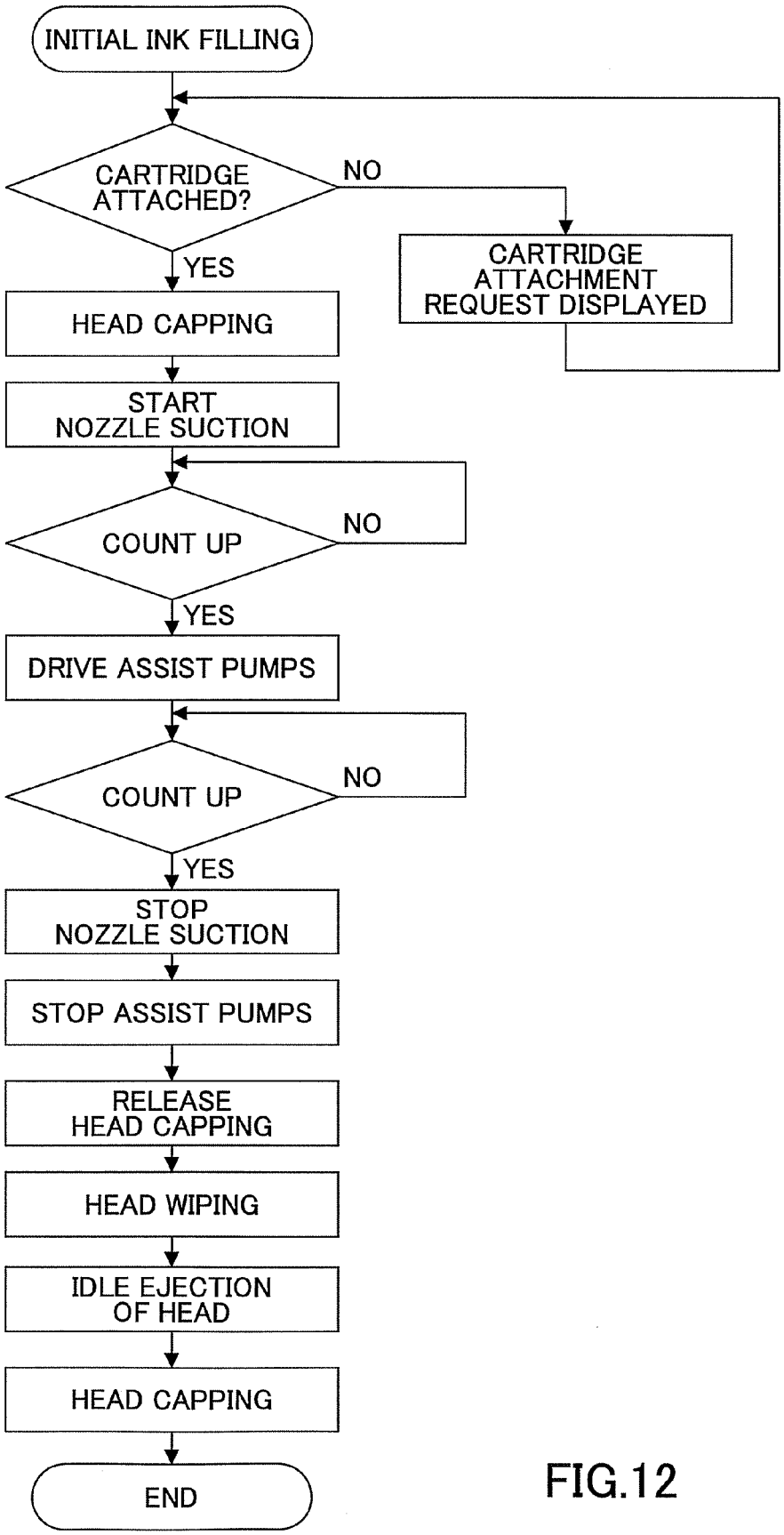
FIG. 12 is a flowchart for explaining an initial ink filling operation.

Next, referring to a flowchart shown in FIG. 12, a description is made of an initial ink filling operation according to this embodiment of the present invention.

After the confirmation of the attachment of the ink cartridge 76, the nozzle surface of the recording head 10 is capped by the cap 52 of the maintenance and restoration mechanism 51. With the nozzle surface capped by the cap 52, the suction pump 53 is driven to suction air inside the ink supply paths via the nozzles of the recording head 10. The suctioning of the air via the nozzles is continued until a predetermined time elapses. After the suctioning of the air for the predetermined time, the ink inside the ink cartridge 76 reaches the first flow path (liquid supply tube) 71.

Then, when a predetermined time elapses (a timer counts up) after starting the suctioning of the air via the nozzles, the motor 82 is driven to drive the pumps 78 of the pump unit 80. Since the ink supply paths are formed as shown in FIG. 9, the air inside the bypass flow path (third flow path) 62 connected to the pumps 78 is pushed out to the liquid supply tube (first flow path) 71 and substituted with the ink when the pumps 78 are driven to supply the liquid (ink) in the direction as indicated by the arrow Qa.

The air pushed out to the liquid supply tube 71 is fed to the recording head 10 by the suctioning of the suction pump 53.

When the suction pump 53 and the pumps 78 are both driven for a predetermined time, all the ink supply paths from the ink cartridge 76 to the recording head 10 can be filled with the ink.

Then, the wiper 57 of the maintenance and restoration mechanism 51 wipes off the nozzle surface of the recording head 10, and the recording head 10 is driven to eject a predetermined number of ink droplets from the nozzles. Thus, desired meniscuses can be formed in the nozzles.

In the manner described above, the initial ink filling operation is completed.

Figure 13:
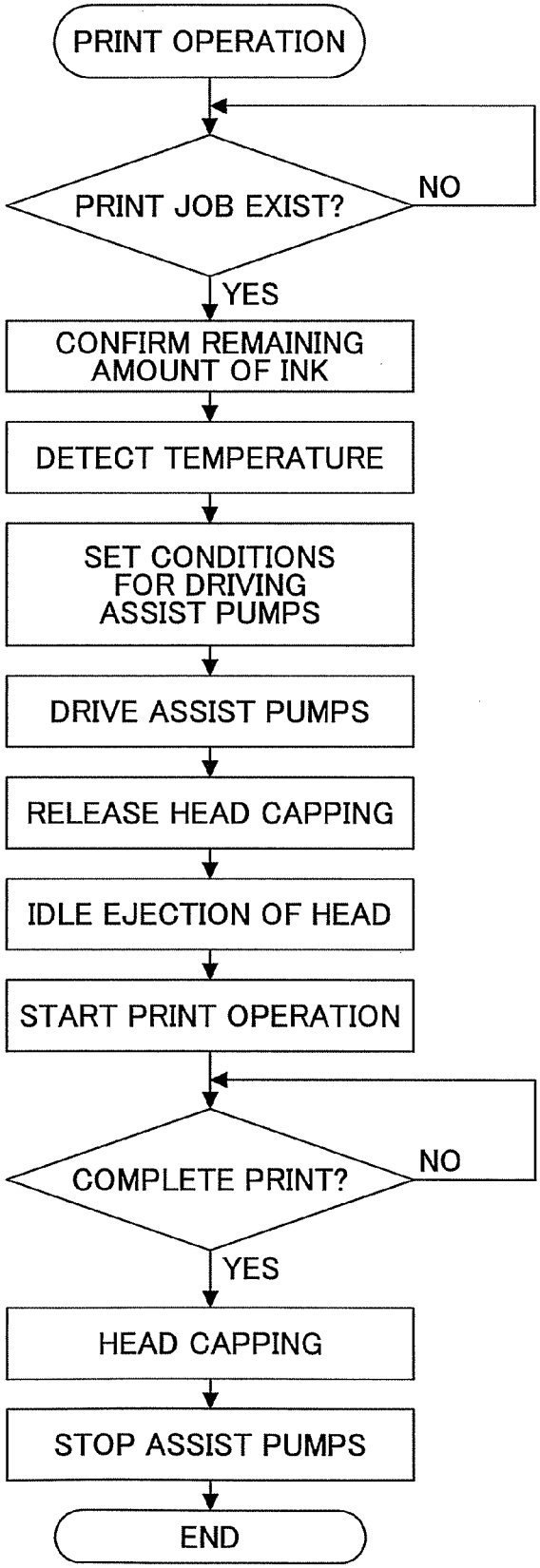
FIG. 13 is a flowchart for explaining a print operation.

Next, referring to a flowchart shown in FIG. 13, a description is made of a print operation according to this embodiment of the present invention.

After the reception of a print job signal, the remaining amount of the ink inside the ink cartridge 76 is confirmed. As a method (detection unit) for confirming the remaining amount of the ink, a method for providing an ink-remaining-amount detection sensor in the ink cartridge 76 to obtain information on the remaining amount of the ink, a method for estimating the remaining amount of the ink based on information on the histories of print and restoration operations, or the like may be employed. Although not shown in the figures, replacement or the like of the ink cartridge 76 is prompted when the remaining amount of the ink is small.

Then, the temperature sensor 27 detects an environmental temperature inside the apparatus to estimate the temperature of the ink. Note that although the temperature sensor 27 is installed in the carriage 4 (see FIG. 2), it may be provided at other places such as the ink cartridge 76 and the recording head 10. Further, the temperature sensor 27 may be provided inside the ink supply paths to directly detect the temperature of the ink.

Next, the flow amount of the ink to be supplied by the assist pumps 78 is determined (conditions for driving the assist pumps 78 are set) based on the temperature of the ink, and the assist pumps 78 are driven. Subsequently, the cap 52 covering the nozzle surface of the recording head 10 is separated from the nozzle surface (capping of the nozzles is released), and the idle ejection of a predetermined number of droplets is performed. After that, the print operation is started.

After the completion of the print operation, the carriage 4 is stopped at the predetermined position (home position) of the apparatus, and the nozzle surface of the recording head 10 is capped by the cap 52. Then, the assist pumps 78 are stopped. Here, the assist pumps 78 may be stopped right after the completion of the print operation.

As described above, in order to perform the print operation, the assist pumps 78 are driven to supply the ink. Therefore, even if the negative pressure inside the recording head 10 is increased due to the water head difference when the remaining amount of the ink inside the ink cartridge 76 is decreased, the negative pressure inside the recording head 10 is reduced to be in a prescribed range by the operation of the pressure control unit 81. Therefore, the ink ejection can be stably performed.

As described above, the ink supply system is configured to have the pressure regulation unit 40 including the flow path that connects the first flow path 71 through which the liquid is supplied to the recording head 10 with the second flow path 60 in communication with the liquid tank 76; the third flow path 62 that bypasses the pressure regulation unit 81 to connect the second flow path 60 or the liquid tank 76 with the first flow path 71; and the liquid supply unit 80 provided in the third flow path 62. Further, the pressure regulation unit 40 is configured to vary the fluid resistance in accordance with the remaining amount of the liquid inside the liquid tank 76, decrease the fluid resistance if the remaining amount of the liquid is equal to or greater than a predetermined amount, increase the fluid resistance if the remaining amount of the liquid is less than the predetermined amount, and supply the liquid with the liquid supply unit 80 to eject liquid droplets from the recording head 10, thereby generating a circulation flow that flows through the third flow path 62 and the flow path of the pressure regulation unit 40. Thus, the increase in the negative pressure caused when the remaining amount of the liquid is decreased can be suppressed, and the negative pressure inside the head 10 can be maintained at an appropriate range with a simple configuration.

Further, since a circulation flow is also generated to perform a maintenance and restoration operation, the head 10 can be maintained at appropriate pressure when the nozzles of the head 10 are clogged. Therefore, the nozzles can be satisfactorily restored, and reliability of the apparatus can be enhanced.

Note that as described above, the image forming apparatus ejects the four colors of ink. Therefore, the four ink supply systems configured as shown in FIG. 9 are provided corresponding to the four colors, respectively. It is also possible to provide four separate actuators such as motors that drive the pumps 78 so as to correspond to the respective colors of pumps 78 and separately control the motors in accordance with the ink ejection amounts of the respective heads 10. However, as shown in FIG. 7, the motor (actuator) 82 may be commonly used for the pumps 78 (78K, 78C, 78M, and 78Y) corresponding to the number of colors.

In other words, the remaining amount of the ink inside the ink cartridge 76 is independently varied depending on the consumption amount of the ink corresponding to the color of ejected droplets. However, in the ink supply system of this embodiment, the cover member 42 of the fluid resistance variable unit 40 is deformed in accordance with the remaining amount of the ink inside the ink cartridge 76. Therefore, even if the pumps 78 supply the liquid of all the colors by the same amount, pressure necessary for each of the colors can be automatically generated.

Further, in the system having plural ink supply systems that use plural ink, the pumps (liquid supply units) of all the ink supply systems can be collectively driven by the single actuator. Therefore, the configuration of the apparatus and controlling the apparatus are simplified, whereby the cost reduction and downsizing of the apparatus can be achieved.

Further, the viscosity of the liquid is generally changed depending on the temperature of the liquid. Therefore, in order to assist the liquid to the recording head 10, temperature around the apparatus and temperature inside the apparatus measured by the temperature sensor 27, temperature of the ink and the prediction value of the temperature, or the like may be fed back to control the driving of the pumps 78. Thus, the apparatus, which is user-friendly and responding to any temperature, is obtained.

Figure 14:
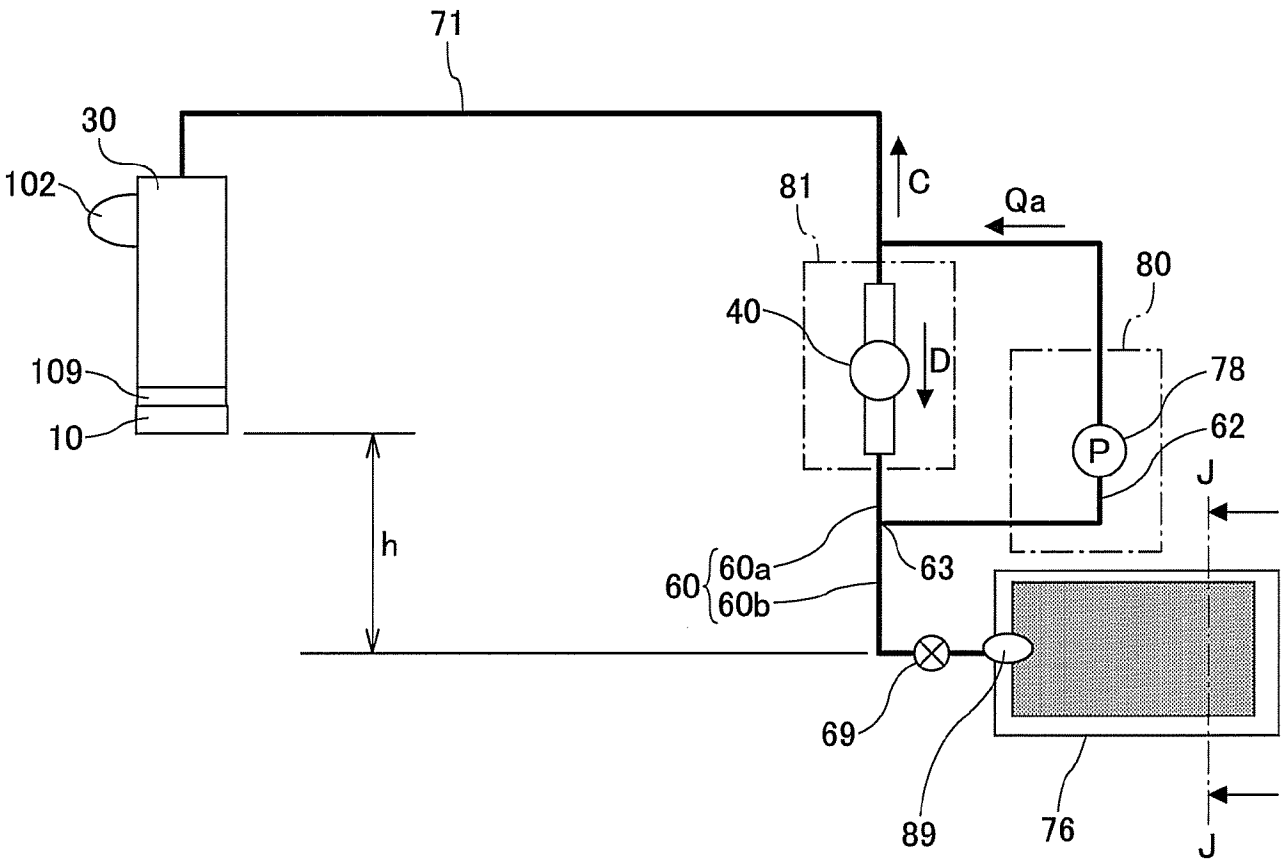
FIG. 14 is an explanatory view of an ink supply system according to a second embodiment of the present invention.
Figure 15A:
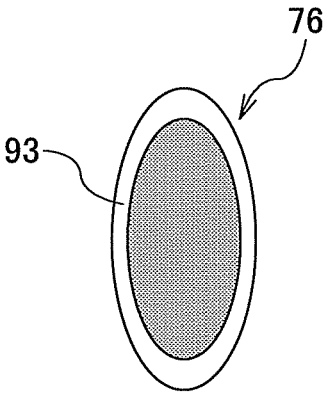
FIGS. 15A and 15B are cross-sectional explanatory views taken along line J-J shown in FIG. 14.
Figure 15B:
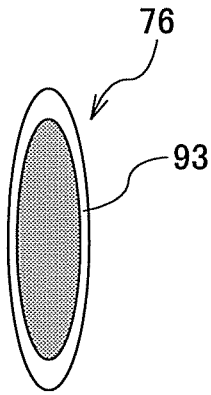

Next, referring to FIG. 14 and FIGS. 15A and 15B, a description is made of an ink supply system according to a second embodiment of the present invention. Note that FIG. 14 is a schematic explanatory view showing the entire configuration of the ink supply system, and FIGS. 15A and 15B are cross-sectional explanatory views taken along line J-J shown in FIG. 14.

First, the ink cartridge 76 has a bag member 93 formed of a flexible material and capable of being deformed (from a status shown in FIG. 15A to a status shown in FIG. 15B) when the ink is consumed, and the liquid is stored in the bag member 93. Further, the ink cartridge 76 is positioned to be lower than the nozzle surface of the head 10.

With this configuration of the cartridge 76, the ink supply system is in a closed state. Therefore, it becomes easy to stably maintain the quality of the liquid to be supplied. Further, the head 10 is configured to be maintained at negative pressure by a vertical interval between the head 10 and the ink cartridge 76. Therefore, the negative pressure inside the head 10 is stabilized.

In the ink supply system of this embodiment, a vertical interval is provided between the head 10 and the ink cartridge 76 to maintain the head 10 at appropriate pressure. In the ink cartridge 76, pressure is gradually reduced when the ink inside the ink cartridge 76 is consumed. Particularly, when the remaining amount of the ink becomes small, the pressure is significantly reduced. As a result, the problems such as unstable ink ejection and a difficulty in restoring the nozzles from their clogged state as described above are caused. In order to address the problems, the ink supply system of this embodiment can prevent the pressure reduction by the supply of the liquid with the pumps 78 and by the operation of the pressure control unit 81.

Figure 16A:
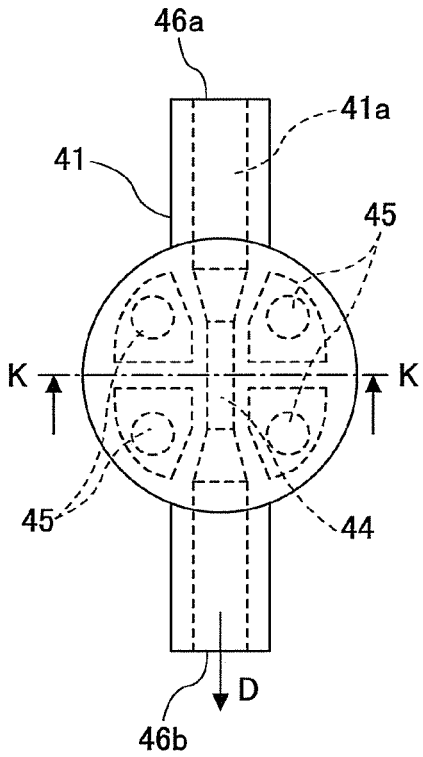
FIGS. 16A through 16D are explanatory views for explaining a fluid resistance variable unit in the second embodiment.
Figure 16B:
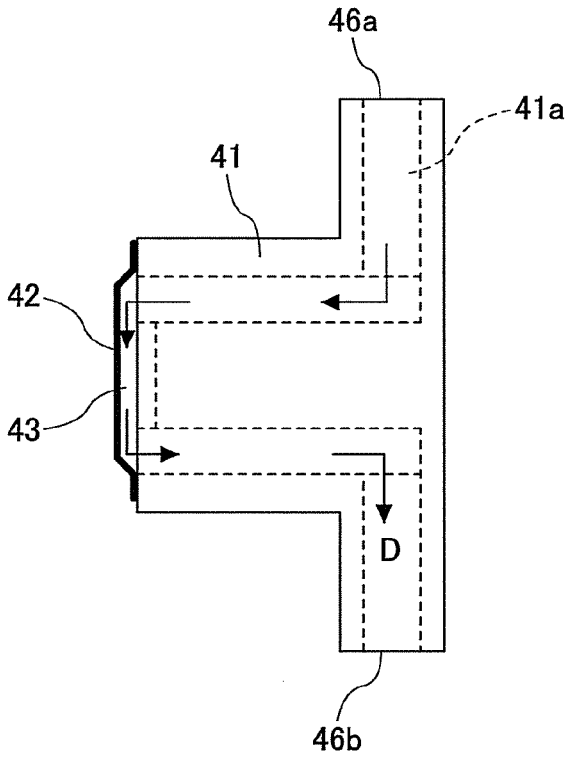
Figure 16C:
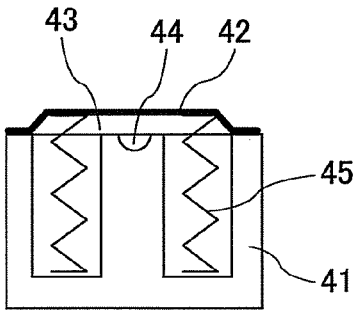
Figure 16D:
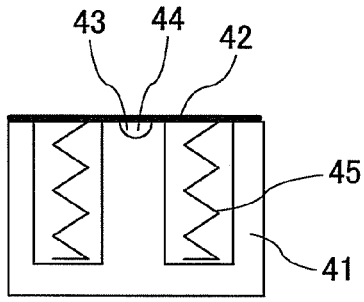

Next, referring to FIGS. 16A through 16D, a description is made of the fluid resistance variable unit 40 of this embodiment. Note that FIG. 16A is a front explanatory view of the fluid resistance variable unit 40, FIG. 16B is a side explanatory view of the fluid resistance variable unit 40 shown in FIG. 16A, and FIGS. 16C and 16D are cross-sectional explanatory views of the fluid resistance variable unit 40 showing different statuses taken along lines K-K shown in FIG. 16A.

The fluid resistance variable unit 40 has a round opening at a part of the flow path 41*a* of the fluid forming member 41 and has the pressure regulation chamber 43 provided with the cover member 42 at the opening. Note that a resin film such as low-density polyethylene is used as the cover member 42 and fixed to the flow path forming member 41 with its periphery heat-sealed.

Further, the cover member 42 is biased by springs 45 provided in the flow path forming member 41 in a direction in which the volume of the pressure regulation chamber 43 increases (in a direction in which fluid resistance decreases). Thus, a unit is provided that presses a flexible member forming the wall surface of the pressure regulation chamber 43 in the direction in which the fluid resistance decreases. Therefore, even if a film member is used as the flexible member, the squeezing amount (fluid resistance) of the pressure regulation chamber 43 can be elastically varied. As a result, characteristics of the pressure regulation chamber 43 can be stabilized.

Moreover, the flow path forming member 41 has a groove 44 acting as a part of the flow path at the central part of its surface opposing the cover member 42.

Next, a description is made of the principle (pressure regulation principle) of preventing the pressure reduction by the supply of the liquid with the pumps 78 and by the operation of the pressure control unit 81 (fluid resistance variable unit 40).

Also, in this embodiment, as shown in FIG. 14, when the ink is supplied by the pumps 78 in the direction as indicated by the arrow Qa, the flow of the ink is divided at the base of the liquid supply tube 71 to thereby produce a circulation flow in the direction as indicated by the arrow D. As a result, the flow of the ink in the direction of the ink cartridge 76 is produced inside the fluid resistance variable unit 40.

The pressure regulation chamber 43 of the fluid resistance variable unit 40 of the pressure control unit 81 is configured to cause the flow path to expand and contract in accordance with its inner pressure. The pressure inside the pressure regulation chamber 43 is relatively great if the remaining amount of the ink inside the ink cartridge 76 is large. In this case, the pressure regulation chamber 43 is largely opened as shown in FIG. 16C. Accordingly, since the circulation flow circulates inside the pressure regulation chamber 43, pressure is hardly generated.

On the other hand, if the remaining amount of the ink inside the ink cartridge 76 gets small, negative pressure inside the pressure regulation chamber 43 becomes great. Therefore, as shown in FIG. 16D, the cover member 42 is deflected inward resisting the biasing force of the springs 45, so that the pressure regulation chamber 43 is narrowed. As a result, the ink flows inside the squeezed flow path, and positive pressure is generated in the pressure regulation chamber 43.

Accordingly, an increase in the negative pressure can be automatically cancelled as the remaining amount of the ink inside the ink cartridge 76 is decreased.

According to this embodiment of the present invention, since the increase in the negative pressure is automatically cancelled as the remaining amount of the ink is decreased, the ink inside the ink cartridge 76 can be completely consumed.

Further, the fluid resistance variable unit 40 of this embodiment has the groove 44 in the pressure regulation chamber 43. Therefore, as shown in FIG. 16D, even if the pressure inside the pressure regulation chamber 43 is reduced to thereby create a state in which the cover member 42 is closely attached to the flow path forming member 42, the flow path is ensured by the groove 44 and communication between the head 10 and the ink cartridge 76 can be maintained.

Further, in this embodiment, an opening/closing valve 69 is provided between the ink cartridge 76 and the fluid resistance variable unit 40 as shown in FIG. 14. The opening/closing valve 69 is driven to be opened when the ink cartridge 76 is attached and driven to be closed when the ink cartridge 76 is extracted.

Accordingly, even if the remaining amount of the ink gets small and the ink cartridge 76 is extracted when the negative pressure inside the pressure regulation chamber 43 is great, the cover member 42 is pressed by the operation of the springs 45 of the fluid resistance variable unit 40. As a result, air is prevented from entering in the ink cartridge 76 via a joint 89.

Figure 17:
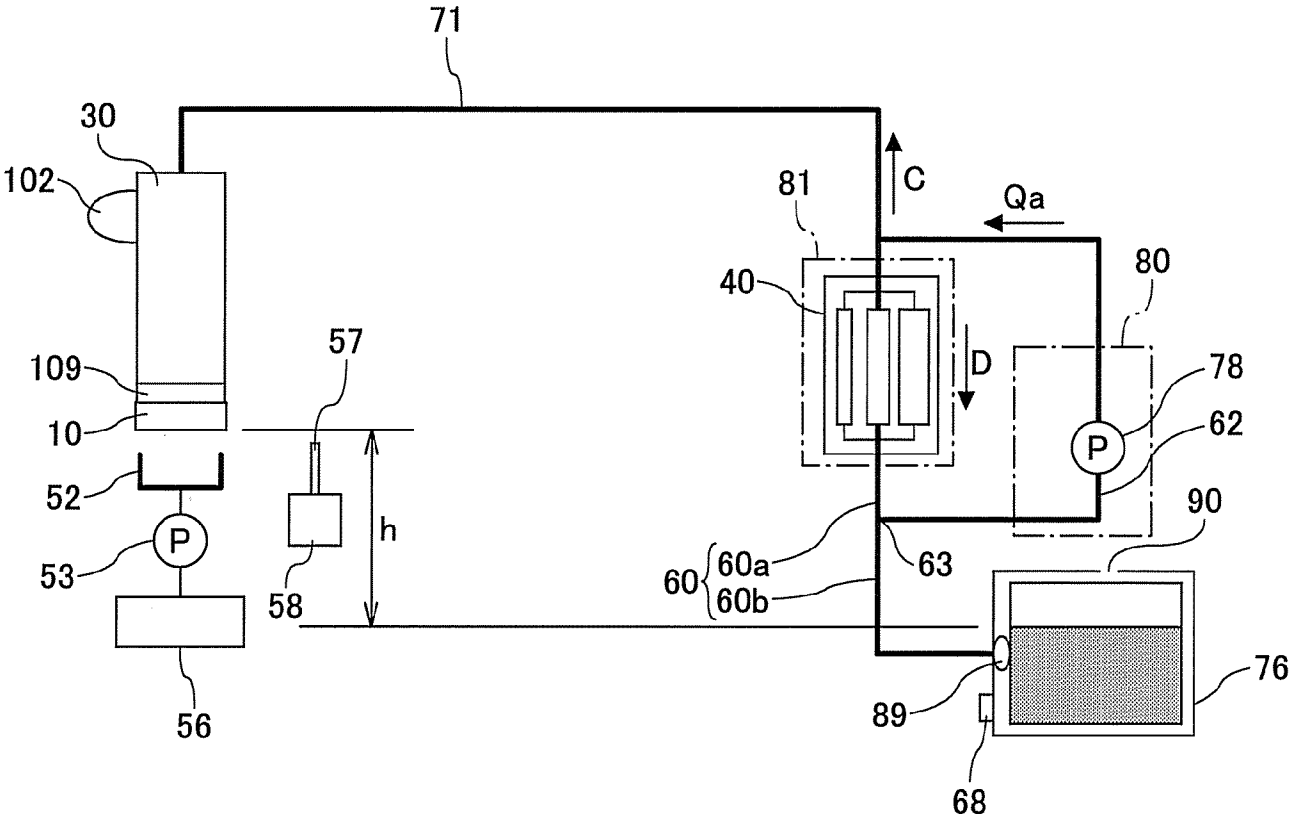
FIG. 17 is an explanatory view of an ink supply system according to a third embodiment of the present invention.

Next, referring to FIG. 17, a description is made of an ink supply system according to a third embodiment of the present invention. Note that FIG. 17 is a schematic explanatory view showing the entire configuration of the ink supply system.

In this embodiment, the ink cartridge 76 is a tank-type ink cartridge having the air communication part 90 as in the ink cartridge 76 of the first embodiment, and a liquid surface inside the ink cartridge 76 is positioned to be lower than the nozzle surface of the recording head 10.

Further, the ink cartridge 76 is provided with an ID chip 68 that stores information on the ink cartridge 76.

Next, referring to FIGS. 18A and 18B, a description is made of the fluid resistance variable unit 40 of this embodiment. Note that FIG. 18A is a front explanatory view of the fluid resistance variable unit 40, and FIG. 18B is a side explanatory view of the fluid resistance variable unit 40 shown in FIG. 18A. The fluid resistance variable unit 40 has three (at least more than one) branch flow paths 47*a* through 47*c*, each of which has a different diameter (fluid resistance), inside the flow path forming member 41. Further, the branch flow paths 47*a* through 47*c* are respectively provided with opening/closing valves 48 (48*a* through 48*c*) with which the flow paths are opened/closed. The opening/closing valves 48*a* through 48*c* are capable of being separately opened and closed, and electromagnetic valves may be used as the opening/closing valves 48*a* through 48*c*. However, in case that the branch flow paths 47*a* through 47*c* have low rigidity, the opening/closing valves 48*a* through 48*c* may also be configured to open/close the flow paths by the pressure inside tubes.

Next, a description is made of pressure control using the fluid resistance variable unit 40.

When the remaining amount of the ink inside the ink cartridge 76 is decreased, a vertical difference (water head difference h) between the head 10 and the liquid surface of the ink inside the ink cartridge 76 becomes large. As a result, negative pressure applied to the head 10 is increased. Therefore, like the above embodiments, a circulation flow in the direction as indicated by the arrow D is produced in the fluid resistance variable unit 40 of the pressure control unit 81 by the assist pumps 78, and positive pressure is produced in the fluid resistance variable unit 40. Thus, the increase in the negative pressure described above is cancelled.

Here, where the flow rate of the liquid supplied by the assist pumps 78 is constant, the larger the fluid resistance of the fluid resistance variable unit 40 is, the greater the produced positive pressure becomes. Therefore, the fluid resistance of the fluid resistance variable unit 40 may be controlled to be increased as the remaining amount of the ink is decreased.

As described above, the fluid resistance variable unit 40 of this embodiment is composed of the tubes 47 having the different diameters and the opening/closing valves 48. Accordingly, for example, as shown in FIG. 19, the fluid resistance variable unit 40 can vary the fluid resistance in seven phases with the combination of the opening and closing statuses of the three opening/closing valves 48*a* through 48*c*. Therefore, by switching the opening and closing statuses of the opening/closing valves 48*a* through 48*c* and selecting the tubes 47*a* through 47*c* to which the ink is to be supplied in accordance with the remaining amount of the ink inside the ink cartridge 76, the fluid resistance variable unit 40 varies the fluid resistance so that the change in the negative pressure inside the head caused when the remaining amount of the ink is changed can be suppressed.

Note that the fluid resistance variable unit 40 may be composed of tubes, each of which has the same diameter and the same length, and opening/closing valves. However, the fluid resistance variable unit 40 thus configured has lesser phases for varying fluid resistance compared with the fluid resistance variable unit 40 of this embodiment. For finer pressure control, it is preferable that the branch paths have different resistances.

Further, in this embodiment, the pressure control is performed with the selection of the plural flow paths having different fluid resistances. However, it is also possible to perform a similar control in such a manner that the fluid resistance variable unit 40 is configured to have a single flow path and vary the fluid resistance when the squeezed status of the flow path is varied.

Figure 20:
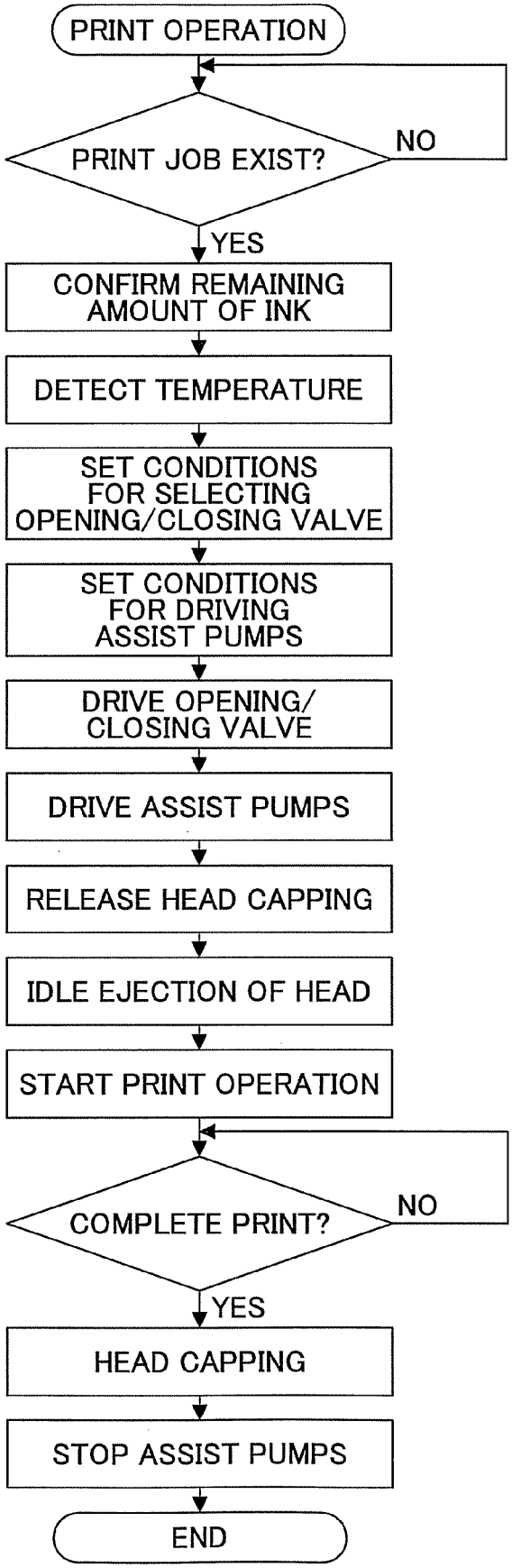
FIG. 20 is a flowchart for explaining a print operation in the third embodiment.

Next, referring to a flowchart shown in FIG. 20, a description is made of a print operation according to this embodiment.

After the reception of a print job signal, the remaining amount of the ink inside the ink cartridge 76 is confirmed. In this embodiment, as described above, information on the remaining amount of the ink is stored in the ID chip 68 provided in the ink cartridge 76. When the ink is consumed by the print operation or the like, information on the amount of the consumed ink is written in the ID chip 68 and the information on the remaining amount of the ink is updated. The information on the remaining amount of the ink is read by a reading unit (not shown) to detect the remaining amount of the ink. Although not shown in the figures, replacement or the like of the ink cartridge 76 is prompted when the remaining amount of the ink is small.

Then, the temperature sensor 27 detects an environmental temperature inside the apparatus to estimate the temperature of the ink. Next, based on information on the temperature of the ink and the information on the remaining amount of the ink, the opening/closing valves 48 to be opened and closed in accordance with the remaining amount of the ink with the combination shown in FIG. 19 described above are determined (conditions for selecting the opening/closing valves are set), and the flow rate to be supplied by the assist pumps 78 is determined (conditions for driving the assist pumps are set).

Then, any of the opening/closing valves 48 selected by the fluid resistance variable unit 40 is opened, and the pumps are driven to supply the liquid thus determined.

Subsequently, the cap 52 covering the nozzle surface of the recording head 10 is separated from the nozzle surface (capping of the nozzles is released), and the idle ejection of a predetermined number of droplets is performed. After that, the print operation is started.

After the completion of the print operation, the carriage 4 is stopped at the predetermined position (home position) of the apparatus, and the nozzle surface of the recording head 10 is capped by the cap 52. Then, the assist pumps 78 are stopped. Here, the assist pumps 78 may be stopped right after the completion of the print operation.

When the print operation described above is performed, the liquid supplying resistance (fluid resistance) of the fluid resistance variable unit 40 is set in accordance with the remaining amount of the ink inside the ink cartridge 76 and an appropriate amount of circulation flow is produced by the assist pumps 78. Therefore, the pressure inside the recording head 10 is lowered in a prescribed range by the operation of the pressure control unit 81 regardless of the remaining amount of the ink. Therefore, ink ejection can be stably performed.

Figure 21:
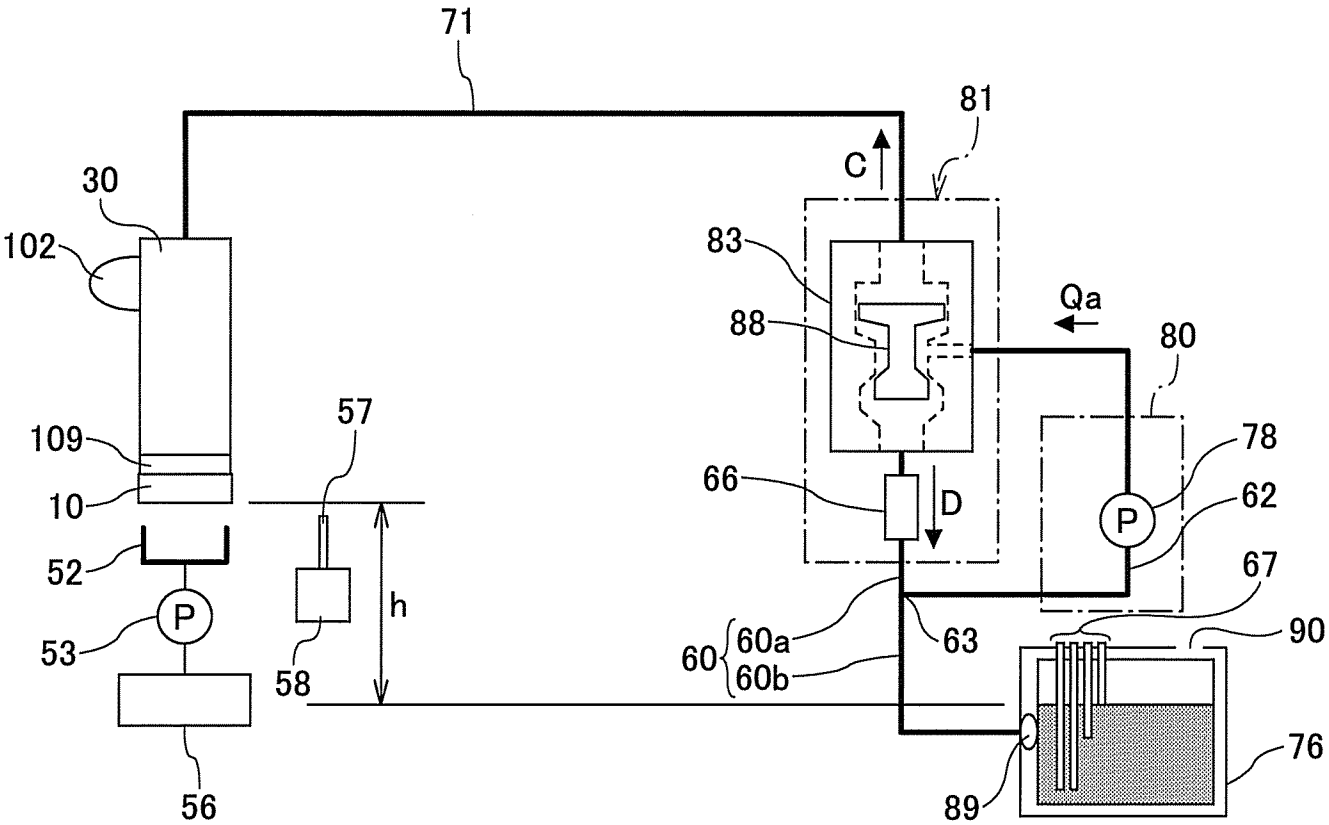
FIG. 21 is an explanatory view of an ink supply system according to a fourth embodiment of the present invention.

Next, referring to FIG. 21, a description is made of an ink supply system according to a fourth embodiment of the present invention. Note that FIG. 21 is a schematic explanatory view showing the entire configuration of the ink supply system.

First, in this embodiment, the ink cartridge 76 is provided with a liquid surface sensor composed of plural electrodes. Further, the pressure control unit 81 is composed of a fluid resistance variable unit 83 and a squeeze member 66. Note that in this embodiment, the fluid resistance variable unit 83 and the squeeze member 66 are separately provided. However, the squeeze member 66 may be provided inside the fluid resistance variable unit 83.

The fluid resistance variable unit 83 has the characteristic of varying fluid resistance according to the flow direction and the flow rate of the liquid flowing inside the fluid resistance variable unit 83. For example, as shown in FIGS. 22A and 22B, the fluid resistance variable unit 83 has a tube member 87 acting as a flow path member (flow path forming member) and a valve body 88 acting as a movable member movably accommodated in the tube member 87 in a free state.

The tube member 87 has a port 86*a* to which the first flow path 71 is connected, a port 86*b* to which the second flow path 60 is connected via the squeeze member 66, and a port (side hole) to which the third flow path 62 is connected. The valve body 88 acting as the movable member is a stepped shaft-shaped member having step parts with different diameters in the flow direction of the liquid. The step parts include at least three step part elements of an upper part (first valve body part) 88*t*, a central part 88*m*, and a lower part (second valve body part) 88*b*, and the diameter of the central part 88*m* is formed to be smaller than the diameter of the second valve body part 88*b*. The valve body 88 is capable of moving inside the tube member 87 and placed at various positions such as a position shown in FIG. 22A, a position shown in FIG. 22B, and an intermediate position between the position shown in FIG. 22A and the position shown in FIG. 22B in accordance with the flowing status of the liquid inside the valve body 88 or the like.

Figure 23:
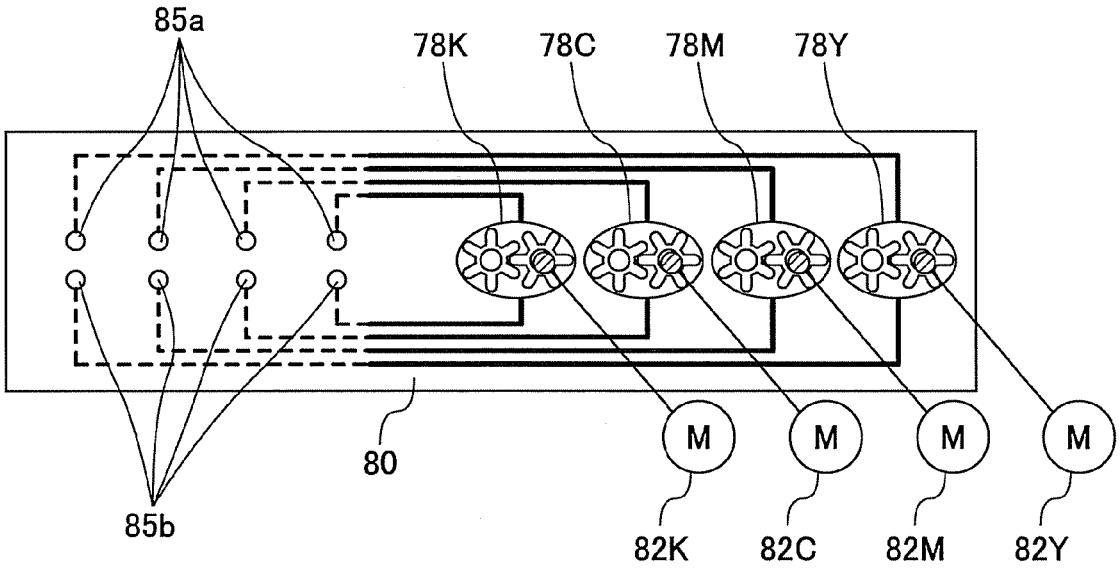
FIG. 23 is an explanatory view for explaining a pump unit in the fourth embodiment.

As shown in FIG. 23, the assist pumps 78 connected to the side hole of the tube member 87 are gear-pump-type assist pumps, and motors 82 (82K, 82C, 82M, and 82Y) are connected to the pumps 78 (78K, 78C, 78M, and 78Y), respectively. Therefore, the pumps 78 can be separately driven.

Figure 22B:
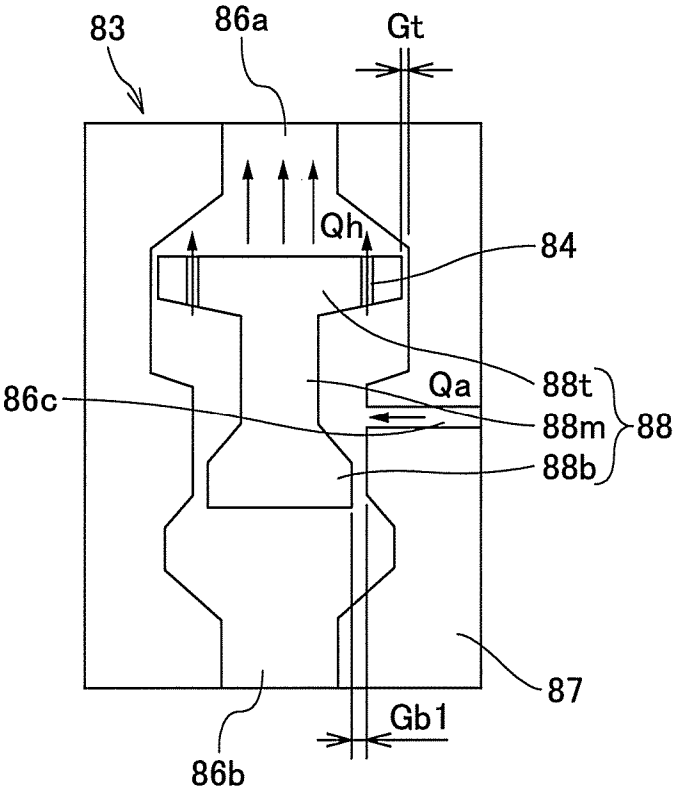
FIGS. 22A and 22B are explanatory views for explaining a fluid resistance variable unit in the fourth embodiment.
Figure 22A:
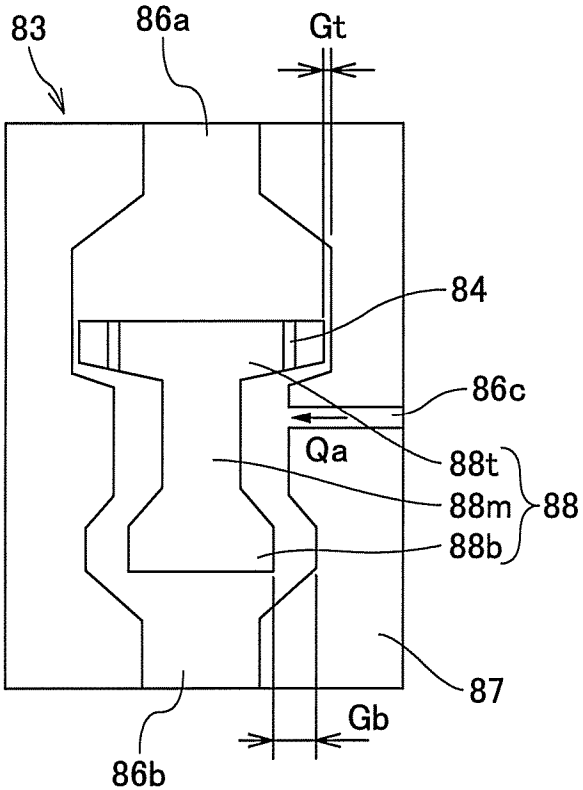

Here, referring to FIGS. 22A and 22B, a description is made of the pressure control principle of this embodiment.

FIG. 22A shows the status of the fluid resistance variable unit 83 where the head 10 is stopped or an ejection flow amount Qh is small. When the fluid resistance variable unit 83 is in this status, the valve body 88 is positioned on the side of the port 86. At this time, since a gap Gb between the tube member 87 and the lower part 88*b* of the valve body 88 is greater than a gap Gt between the tube member 87 and the upper part 88*t* of the valve body 88 and there are the tube 71 having large fluid resistance and the filter 109 forward of the port 86*a* as shown in FIG. 21, the ink supplied by the pumps 78 as indicated by the arrow Qa naturally flows to the side of the port 86*b*.

Accordingly, the ink supplied by the pumps 78 circulates inside a loop path formed by the pump unit 80 and the fluid resistance variable unit 83 in FIG. 21.

At this time, since the ink flows in the squeeze member 66, positive pressure determined by the fluid resistance of the squeeze member 66 and the flow amount of the ink is produced.

FIGS. 22A and 22B show the statuses of the fluid resistance variable unit 83 where the ejection amount of the head 10 is large. With the gap Gt between the tube member 87 and the upper part 88*t* set to be small, the ink flows in through-holes 84 in a direction as indicated by arrows Qh when liquid droplets are ejected from the head 10 and the valve body 88 is attracted to the side of the port 86*a*. Therefore, the valve body 88 is moved. Thus, the lower part 88*b* of the valve body 88 is moved to the small diameter part of the tube member 87, whereby the tube member 87 and the lower part 88*b* of the valve body 88 have a small gap Gb1 between them.

At this time, since the ink supplied by the pumps 78 in the direction as indicated by the arrow Qa (where the amount of the ink supplied in the direction as indicated by the arrow Qa is generally greater than the amount of the ink supplied in the direction as indicated by the arrows Qh) naturally flows in the small gap Gb1, pressure (PA) is produced. This pressure reduces a pressure loss generated when the ink flows in the head 10. As a result, large amounts of the ink can be supplied.

Further, at the same time, since the ink flows in the squeeze member 66 in the direction as indicated by the arrow D, positive pressure (PB) determined by the fluid resistance of the squeeze member 66 and the flow amount of the ink is also produced.

Here, a description is made of the characteristics of the pressure (PA) and the pressure (PB). First, the pressure (PA) is determined by the squeezing amount of the gap Gb1 determined by the position (balanced position) of the valve body 88 and the flow amount (Qa−Qh) of the ink flowing in the gap Gb1. The position of the valve body 88 is determined by a balance between the upward force of the valve body 88 generated according to the ejection flow amount Qh of the head 10 and the downward force of the valve body 88 generated when the ink flows in the gap Gb1. Accordingly, since the balanced position of the valve body 88 is moved upward as shown in FIG. 22B when the ejection flow amount Qh of the head 10 becomes large, the squeezing amount of the gap Gb1 is increased and the pressure (PA) becomes great.

On the other hand, when the flow amount (assist flow amount) Qa of the ink supplied by the pumps 78 is increased, a force for moving the valve body 88 downward is increased and the valve body 88 is moved downward. Therefore, the assist pressure (PA) remains the same. In other words, when the flow amount Qa is increased, the flow amount of the ink flowing in the gap Gb1 is increased. However, since fluid resistance of the fluid resistance variable unit 83 is decreased at the gap Gb1, the resulting assist pressure (PA) becomes constant.

Conversely, the pressure (PB) produced by the squeeze member 66 is increased in proportion to the assist flow amount Qa since the fluid resistance is constant.

As described above, in this embodiment, the pressure (PB) that is increased in proportion to the flow amount Qa of the ink supplied by the pumps 78 can be produced with the squeeze member 66. Therefore, with the control of the flow amount Qa of the ink supplied by the assist pumps 78, the increase in the negative pressure caused when the remaining amount of the ink inside the ink cartridge 76 is decreased can be lowered in a prescribed range.

Further, since the pressure inside the head 10 can be freely controlled in accordance with the flow amount Qa of the ink supplied by the assist pumps 78, it is also possible to arrange the ink cartridge 76 down below within the limitation of the water head pressure of the meniscus holding force of the head 10.

Further, since the head 10 can be regulated at appropriate pressure when the nozzles of the head 10 are clogged, the nozzles can be satisfactorily restored. As a result, the reliability of the apparatus can be enhanced.

As described above, the ink supply system is configured to have the first flow path 71 through which the liquid is supplied to the recording head 10; the second flow path 60 in communication with the liquid tank 76; the fluid resistance part 83 including the flow path that connects the first flow path 71 with the second flow path 60; the third flow path 62 that bypasses the fluid resistance part 83 to connect the second flow path 60 or the liquid tank 76 with the first flow path 71; the liquid supply unit 80 provided in the third flow path 62; and the unit 66 that supplies the liquid with the liquid supply unit 80 to eject liquid droplets from the recording head 10, thereby generating a circulation flow that flows through the third flow path 62 and the flow path of the fluid resistance part 83. The unit 66 controls the flow rate to be supplied by the liquid supply unit 78 to be decreased if the remaining amount of the liquid is equal to or greater than a predetermined amount and the fluid resistance to be increased if the remaining amount of the liquid is less than the predetermined amount in accordance with the remaining amount of the liquid inside the liquid tank 76. Thus, the increase in the negative pressure caused when the remaining amount of the liquid is decreased can be suppressed, and the negative pressure inside the head 10 can be maintained at an appropriate range with a simple configuration.

Figure 24:
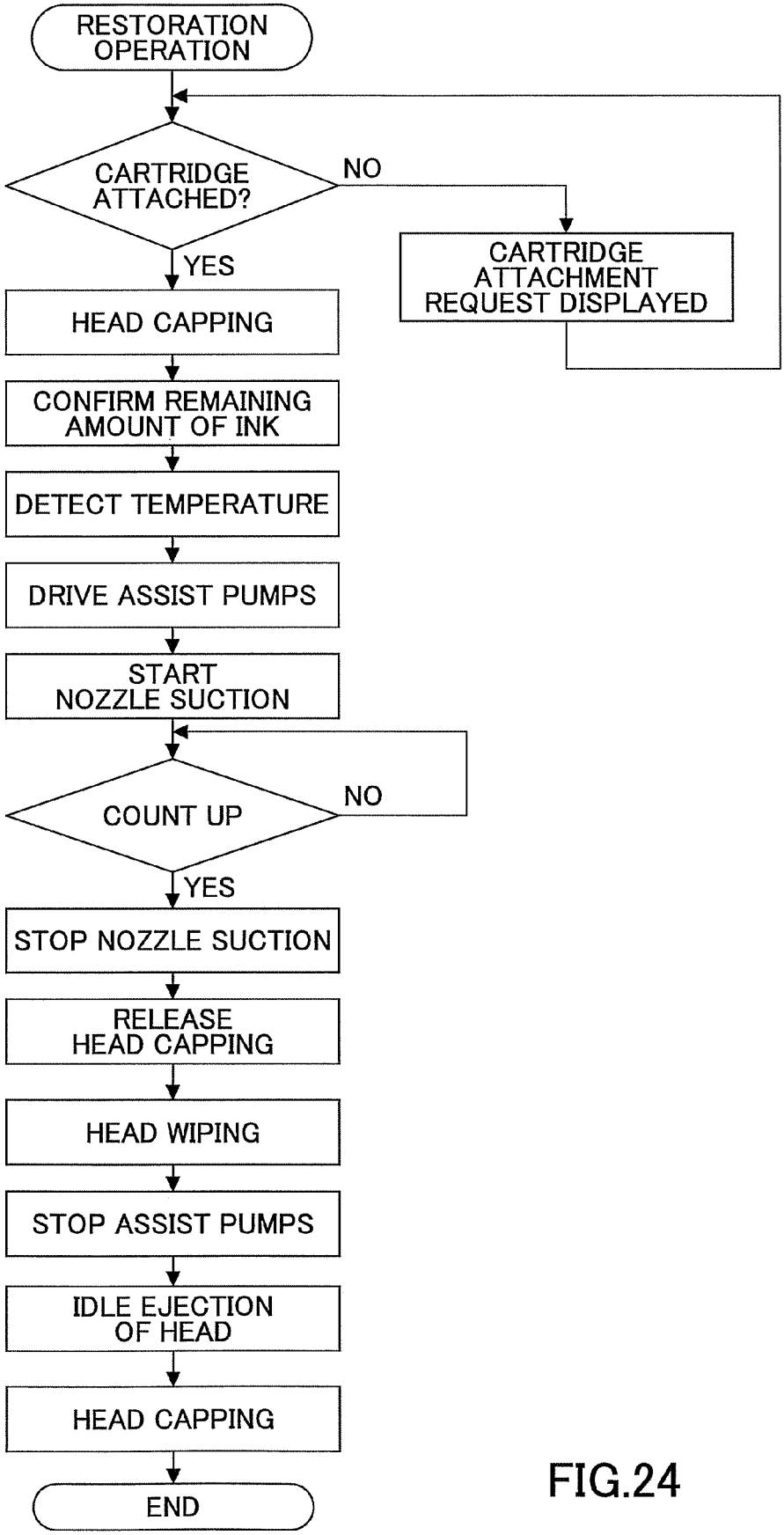
FIG. 24 is a flowchart for explaining a maintenance and restoration operation in the fourth embodiment.

Next, referring to a flowchart shown in FIG. 24, a description is made of the nozzle restoration operation of this embodiment.

First, a determination is made as to whether the ink cartridge 76 has been attached to the cartridge holder 77. If it is determined that the ink cartridge 76 has not been attached, a cartridge attachment request is displayed on the operations panel 514.

If it is determined that the ink cartridge 76 has been attached, the cap 52 of the maintenance and restoration unit 51 is moved upward to cap the nozzle surface of the head 10.

Then, the remaining amount of the ink inside the ink cartridge 76 is confirmed by the liquid surface sensor 67 of the ink cartridge 76, and an environmental temperature is detected by the temperature sensor 27. Thus, conditions for driving the pumps 78 are determined, and the pumps 78 are driven to supply the ink.

When the ink is supplied by the pumps 78, positive pressure is produced in the pressure control unit 81 and negative pressure inside the head 10 is reduced. As a result, the restoration of the nozzles can be enhanced.

Next, the suction pump 53 is driven to produce negative pressure inside the cap 52 so that the ink is suctioned and ejected from the nozzles.

Thus, air bubbles and foreign matter mixed with the ink are ejected from the nozzles 15 of the head 10.

Then, after a predetermined time elapses (count up), the driving of the suction pump 53 is stopped to stop the suctioning operation of the nozzles. Subsequently, the cap 52 is separated from the nozzle surface of the head 10 (capping of the nozzles is released), the nozzle surface is wiped off by the wiper member 57 of the maintenance and restoration unit 51, and the driving of the pumps 78 is stopped.

Thus, meniscuses are formed at the nozzle surface.

After that, liquid droplets (idle ejection) irrelevant to image formation are ejected from the head 10, the cap 52 is moved upward to cap the nozzle surface of the head 10, and the restoration operation is completed.

As described above, the ink supply system is configured to have the first flow path 71 through which the liquid is supplied to the recording head 10; the second flow path 60 in communication with the liquid tank 76; the fluid resistance part 83 including the flow path that connects the first flow path 71 with the second flow path 60; the third flow path 62 that bypasses the fluid resistance part 83 to connect the second flow path 60 or the liquid tank 76 with the first flow path 71; the liquid supply unit 80 provided in the third flow path 62; and the unit 66 that supplies the liquid with the liquid supply unit 80 to perform the maintenance and restoration operation for the recording head 10, thereby generating a circulation flow that flows through the third flow path 62 and the flow path of the fluid resistance part 83. The unit 66 controls the flow rate to be supplied by the liquid supply unit 78 to be decreased if the remaining amount of the liquid is equal to or greater than a predetermined amount and the fluid resistance to be increased if the remaining amount of the liquid is less than the predetermined amount in accordance with the remaining amount of the liquid inside the liquid tank 70. Thus, the increase in the negative pressure caused when the remaining amount of the liquid is decreased can be suppressed, and the negative pressure inside the head 10 can be maintained at an appropriate range with a simple configuration. As a result, the maintenance and restoration of the head can be enhanced.

Next, a description is made of the effects of the print operation of this embodiment. As described above, the ink supply system of this embodiment is configured to have the pressure control unit 81 in the supply flow path through which the liquid is supplied from the liquid tank 76 to the head 10; the flow path 62 in the pressure control unit 81 to be in communication with the ink cartridge 76 as another flow path; the pumps 78 in the flow path 62 as the liquid supply unit; and the fluid resistance variable unit 83 that varies the fluid resistance in accordance with the flow rate of the liquid flowing in the head 10 inside the pressure control unit 81.

In ejecting the liquid from the head 10, the liquid is supplied to the head 10 by the assist pumps 78 in a state in which the head 10 and the ink cartridge 76 are connected with each other. Therefore, it is possible to apply pressure to the head 10 while automatically regulating appropriate assist pressure in accordance with the amount of the ink ejected from the head 10. Thus, it is possible to easily prevent the elongation of the liquid supply tube 71, an increase in the flow rate of the liquid to be ejected, and the shortage of refill due to the high viscosity or the like of the liquid to be ejected.

Figure 25:
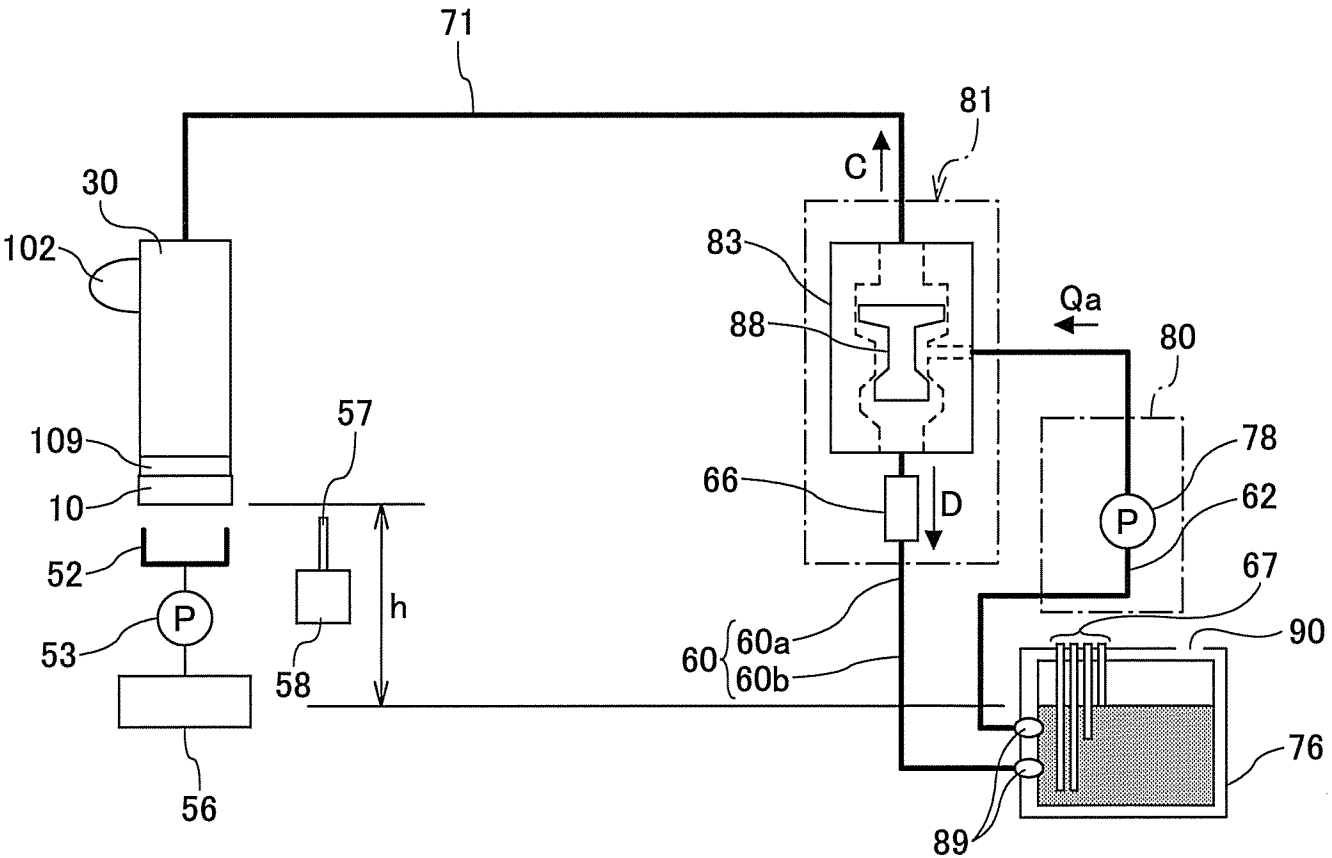
FIG. 25 is an explanatory view of an ink supply system according to a fifth embodiment of the present invention.

Next, referring to FIG. 25, a description is made of an ink supply system according to a fifth embodiment of the present invention. Note that FIG. 25 is a schematic explanatory view showing the entire configuration of the ink supply system. In this embodiment, the ink supply system is configured to directly connect the third flow path 62 to the ink cartridge 76. This configuration can also be applied to the first through third embodiments.

With this configuration, the ink supply system of this embodiment can also obtain the same effects as those of the above respective embodiments.

Note that the operations and effects of the embodiments of the present invention are described above using the example in which the different colors of ink is supplied to the plural heads. However, the embodiments of the present invention can also be applied to a case in which the same color of ink is supplied to the plural heads or a case in which ink different in prescription rather than color is supplied to the plural heads. Further, the embodiments of the present invention can also be applied to a liquid supply system in which a head has plural nozzle arrays and different types of liquid are ejected from the head. Further, the embodiments of the present invention are not limited to image forming apparatuses that eject ink in a narrow sense but can also be applied to liquid ejection apparatuses (included in the "image forming apparatus" in the present invention) that eject various liquids.

The present invention is not limited to the specifically disclosed embodiments, and variations and modifications may be made without departing from the scope of the present invention.

The present application is based on Japanese Priority Application No. 2010-045258 filed on Mar. 2, 2010, the entire contents of which are hereby incorporated herein by reference.

What is claimed is:

1. An image forming apparatus comprising:

a recording head having, disposed in a nozzle surface of the recording head, nozzles from which liquid droplets are ejected;

a liquid tank that stores a liquid to be supplied to the recording head;

a first flow path through which the liquid is supplied to the recording head;

a second flow path in communication with the liquid tank;

a pressure regulation unit having a flow path that connects the first flow path with the second flow path;

a third flow path that bypasses the pressure regulation unit to connect the second flow path or the liquid tank with the first flow path; and a liquid supply unit provided in the third flow path;

wherein the pressure regulation unit varies a fluid resistance in accordance with a remaining amount of the liquid inside the liquid tank, decreases the fluid resistance if the remaining amount of the liquid is equal to or greater than a predetermined amount, increases the fluid resistance if the remaining amount of the liquid is less than the predetermined amount, and supplies the liquid with the liquid supply unit to eject the liquid droplets from the recording head, thereby generating a circulation flow that flows through the third flow path and the flow path of the pressure regulation unit, wherein the liquid tank is configured to be open to atmosphere, and the liquid tank and the recording head are disposed relative to each other such that a surface of the liquid stored in the liquid tank open to the atmosphere is located at a position that is lower than the nozzle surface of the recording head so as to cause the recording head to generate a negative pressure due to a water head difference between the nozzle surface of the recording head and the surface of the liquid inside the liquid tank, the fluid resistance inside the pressure regulation unit is changed in accordance with a change in the water head difference between the nozzle surface of the recording head and the surface of the liquid inside the liquid tank due to a change in the liquid surface inside the liquid tank, the liquid supply unit disposed in the third flow path supplies the liquid in a direction from the liquid tank toward the recording head, such that a remaining liquid of the liquid supplied from the liquid supply unit to the recording head flows back in a direction from the recording head towards the liquid tank inside the pressure regulation unit to generate a circulation flow that passes through the third flow path and returns to the liquid supply unit, a pressure in accordance with the fluid resistance of the pressure regulation unit is generated in a state in which the liquid supplied by the liquid supply unit flows in the direction from the liquid tank toward the recording head inside the pressure regulation unit, and when a negative pressure of the recording head is increased due to an increase in the water head difference between the nozzle surface of the recording head and the liquid surface of the liquid tank, caused by a decrease in the remaining amount of liquid inside the liquid tank, the increase in the negative pressure of the recording head is cancelled by increasing the fluid resistance to increase the pressure generated by the circulation flow to generate a high positive pressure inside the pressure regulation unit.

2. The image forming apparatus according to claim 1, wherein the pressure regulation unit varies the fluid resistance according to a pressure difference between the pressure regulation unit and the liquid tank.

3. The image forming apparatus according to claim 2, wherein a part of the flow path of the pressure regulation unit is formed of a flexible member, and the flexible member is deformed in accordance with the remaining amount of the liquid inside the liquid tank.

4. The image forming apparatus according to claim 3, wherein the flexible member comprises an elastic member.

5. The image forming apparatus according to claim 3, further comprising:

a unit that presses the flexible member in a direction in which the fluid resistance decreases.

6. The image forming apparatus according to claim 1, wherein a wall surface of the flow path of the pressure regulation unit is formed of a flexible member, and the pressure inside the pressure regulation unit is changed in accordance with the remaining amount of liquid in the liquid tank to deform the flexible member, such that the fluid resistance is changed by changing a length of a gap forming the flow path in the pressure regulation unit, wherein when the remaining amount of liquid is greater than the predetermined amount, the fluid resistance is reduced by causing the flexible member to deform in a direction in which the length of the gap forming the flow path in the pressure regulation unit is increased, wherein when the remaining amount of liquid is less than the predetermined amount, the fluid resistance is increased by causing the flexible member to deform in a direction in which the length of the gap forming the flow path in the pressure regulation unit is decreased, and wherein when the recording head ejects liquid droplets, the liquid supply unit supplied the liquid to generate the circulation flow that passes through the third flow path and also passes through the gap forming the flow path in the pressure regulation unit.

* * * * *